US012168756B2

(12) United States Patent
Naito et al.

(10) Patent No.: US 12,168,756 B2
(45) Date of Patent: Dec. 17, 2024

(54) VISCOSITY INDEX IMPROVER COMPOSITION AND LUBRICATING OIL COMPOSITION

(71) Applicant: SANYO CHEMICAL INDUSTRIES, LTD., Kyoto (JP)

(72) Inventors: Nobuhiro Naito, Kyoto (JP); Hiroki Yamashita, Kyoto (JP); Kenyuu Yoshida, Kyoto (JP); Hiroki Hagihara, Kyoto (JP)

(73) Assignee: SANYO CHEMICAL INDUSTRIES, LTD., Kyoto (JP)

( * ) Notice: Subject to any disclaimer, the term of this patent is extended or adjusted under 35 U.S.C. 154(b) by 0 days.

(21) Appl. No.: 18/021,222

(22) PCT Filed: Aug. 20, 2021

(86) PCT No.: PCT/JP2021/030641
§ 371 (c)(1),
(2) Date: Feb. 14, 2023

(87) PCT Pub. No.: WO2022/039266
PCT Pub. Date: Feb. 24, 2022

(65) Prior Publication Data

US 2023/0340357 A1 Oct. 26, 2023

(30) Foreign Application Priority Data

Aug. 20, 2020 (JP) ..... 2020-139030

(51) Int. Cl.

| | |
|---|---|
| ***C10M 145/14*** | (2006.01) |
| ***C10M 129/06*** | (2006.01) |
| ***C10M 169/04*** | (2006.01) |
| *C10N 20/02* | (2006.01) |
| *C10N 20/04* | (2006.01) |
| *C10N 30/00* | (2006.01) |
| *C10N 30/02* | (2006.01) |
| *C10N 30/18* | (2006.01) |

(52) U.S. Cl.
CPC ..... *C10M 145/14* (2013.01); *C10M 129/06* (2013.01); *C10M 169/044* (2013.01); *C10M 2207/021* (2013.01); *C10M 2209/084* (2013.01); *C10N 2020/02* (2013.01); *C10N 2020/04* (2013.01); *C10N 2030/02* (2013.01); *C10N 2030/18* (2013.01); *C10N 2030/54* (2020.05)

(58) Field of Classification Search
CPC ..... C10M 145/14; C10M 129/06; C10M 169/044; C10M 2207/021; C10M 2209/084; C10N 2030/54; C10N 2020/02; C10N 2020/04; C10N 2030/02; C10N 2030/18
See application file for complete search history.

(56) References Cited

U.S. PATENT DOCUMENTS

| | | | |
|---|---|---|---|
| 5,188,770 | A | 2/1993 | Pennewiss |
| 2002/0123583 | A1 | 9/2002 | Gore et al. |
| 2003/0036488 | A1 | 2/2003 | Yuki et al. |
| 2008/0194443 | A1 | 8/2008 | Stohr et al. |
| 2014/0179572 | A1* | 6/2014 | Loper ..... C10M 141/06 508/513 |
| 2015/0175926 | A1 | 6/2015 | Matsui et al. |
| 2015/0184109 | A1 | 7/2015 | Matsui et al. |
| 2015/0197705 | A1 | 7/2015 | Matsui et al. |
| 2015/0203781 | A1 | 7/2015 | Matsui et al. |
| 2015/0203782 | A1 | 7/2015 | Matsui et al. |
| 2015/0203785 | A1 | 7/2015 | Matsui et al. |
| 2015/0322370 | A1 | 11/2015 | Matsui et al. |
| 2018/0245014 | A1 | 8/2018 | Nakada et al. |
| 2020/0317838 | A1 | 10/2020 | Takahashi et al. |

FOREIGN PATENT DOCUMENTS

| | | |
|---|---|---|
| CN | 1891804 | 1/2007 |
| CN | 104395445 | 3/2015 |

(Continued)

OTHER PUBLICATIONS

Office Action issued Dec. 15, 2023 in corresponding Chinese Patent Application No. 202180050782.8, with English language translation.
"Progress in Antifoaming Research", Tenhimbus, Advances in Fine Petrochemicals, vol. I, Issue 7, pp. 44-48, Jul. 2000.
International Search Report issued Oct. 5, 2021 in International (PCT) Patent Application No. PCT/JP2021/030641.

*Primary Examiner* — Cephia D Toomer
(74) *Attorney, Agent, or Firm* — Wenderoth, Lind & Ponack, L. L.P.

(57) ABSTRACT

The present invention aims to provide a viscosity index improver composition capable of providing a lubricant composition that has an excellent viscosity index improving effect, excellent antifoaming properties, and excellent persistence of the antifoaming properties. The present invention relates to a viscosity index improver composition, containing: a (co)polymer (A) containing a monomer (a) represented by the following formula (1) as an essential monomer; a C18-C40 chain aliphatic alcohol (B); and a base oil, [Chem. 1]

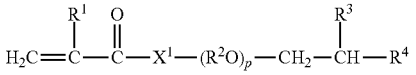

(1)

wherein $R^1$ is a hydrogen atom or a methyl group; —$X^1$— is a group represented by —O— or —NH—; $R^2$ is a C2-C4 alkylene group; $R^3$ and $R^4$ are each independently a C8-C24 linear or branched alkyl group; and p is an integer of 0 to 20, with each $R^2$ being optionally the same as or different from each other when p is 2 or greater.

6 Claims, No Drawings

(56) References Cited

FOREIGN PATENT DOCUMENTS

| | | |
|---|---|---|
| CN | 107406789 | 11/2017 |
| EP | 0 570 093 | 11/1993 |
| EP | 2 343 357 | 7/2011 |
| JP | 7-62372 | 3/1995 |
| JP | 2732187 | 12/1997 |
| JP | 2941392 | 6/1999 |
| JP | 2004-307551 | 11/2004 |
| JP | 4220599 | 2/2009 |
| JP | 4283120 | 6/2009 |
| JP | 2009-536685 | 10/2009 |
| JP | 2013-203849 | 10/2013 |
| JP | 5376946 | 12/2013 |
| JP | 2018-16798 | 2/2018 |
| JP | 2018-48328 | 3/2018 |
| JP | 2019-156953 | 9/2019 |
| JP | 2020-164497 | 10/2020 |
| WO | 2007/133995 | 11/2007 |
| WO | 2017/122721 | 7/2017 |
| WO | 2018/101342 | 6/2018 |

* cited by examiner

VISCOSITY INDEX IMPROVER COMPOSITION AND LUBRICATING OIL COMPOSITION

TECHNICAL FIELD

The present invention relates to viscosity index improver compositions and lubricant compositions.

TECHNICAL FIELD

As a means to improve fuel economy, a lubricant with lower viscosity has been recently used to reduce viscosity resistance. However, a lubricant with lower viscosity causes various problems such as oil leakage and seizure.

Meanwhile, use of a viscosity index improver has been proposed as another means to improve fuel economy. A lubricant having a higher viscosity index has lower viscosity resistance at low temperature, which leads to improved fuel economy. Thus, it is a common practice to add a viscosity index improver to a lubricant to modify the temperature dependence of the viscosity. Known examples of such a viscosity index improver include methacrylate ester copolymers (Patent Literatures 1 to 4), an olefin copolymer (Patent Literature 5), and a macromonomer copolymer (Patent Literature 6).

Also, a lubricant with lower viscosity developed for the purpose of improving fuel economy suffers from problems. As a result, foaming such as cavitation increases and problems such as poor lubrication, mechanical loss, and increased noise occur. These problems cancel out the effect of improving fuel economy owing to the lubricant with lower viscosity, leading to an increase in the load on the environment. To solve such problems, polysiloxane antifoaming agents (Patent Literature 7) have been used.

The viscosity index improving effect of the lubricant compositions described above is still insufficient. In addition, since polysiloxane antifoaming agents have insufficient antifoaming properties and have low shear stability, these antifoaming agents are difficult to maintain antifoaming performance for a long time.

CITATION LIST

Patent Literature

Patent Literature 1: JP 2732187 B
Patent Literature 2: JP 2941392 B
Patent Literature 3: JP H07-62372 A
Patent Literature 4: JP 2004-307551 A
Patent Literature 5: JP 4283120 B
Patent Literature 6: JP 5376946 B
Patent Literature 7: JP 4220599 B

SUMMARY OF INVENTION

Technical Problem

The present invention aims to provide a viscosity index improver composition capable of providing a lubricant composition that has an excellent viscosity index improving effect, excellent antifoaming properties, and excellent persistence of the antifoaming properties.

Solution to Problem

As a result of extensive studies to achieve the above purpose, the present inventors completed the present invention.

Specifically, the present invention relates to a viscosity index improver composition, containing: a (co)polymer (A) containing a monomer (a) represented by the following formula (1) as an essential monomer; a C18-C40 chain aliphatic alcohol (B); and a base oil. The present invention also relates to a lubricant composition, containing: the viscosity index improver composition; and at least one additive selected from the group consisting of a detergent, a dispersant, an antioxidant, an oiliness improver, a pour point depressant, a friction and wear modifier, an extreme pressure agent, a demulsifier, a metal deactivator, and a corrosion inhibitor.

[Chem. 1]

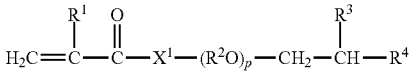

(1)

In the formula (1), $R^1$ is a hydrogen atom or a methyl group; —$X^1$— is a group represented by —O— or —NH—; $R^2$ is a C2-C4 alkylene group; $R^3$ and $R^4$ are each independently a C8-C24 linear or branched alkyl group; and p is an integer of 0 to 20, with each $R^2$ being optionally the same as or different from each other when p is 2 or greater.

Advantageous Effects of Invention

The present invention can provide a viscosity index improver composition capable of providing a lubricant composition that has an excellent viscosity index improving effect, excellent antifoaming properties, and excellent persistence of the antifoaming properties.

In the present invention, the phrase "persistence of antifoaming properties" means that a lubricant composition can maintain antifoaming properties after being subjected to long-term operation in practical use.

DESCRIPTION OF EMBODIMENTS

The viscosity index improver composition of the present invention contains a (co)polymer (A) containing a monomer (a) represented by the following formula (1) as an essential monomer; a C18-C40 chain aliphatic alcohol (B); and a base oil,

[Chem. 1]

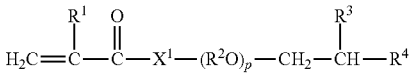

(1)

wherein $R^1$ is a hydrogen atom or a methyl group; —$X^1$— is a group represented by —O— or —NH—; $R^2$ is a C2-C4 alkylene group; $R^3$ and $R^4$ are each independently a C8-C24 linear or branched alkyl group; and p is an integer of 0 to 20, with each $R^2$ being optionally the same as or different from each other when p is 2 or greater.

In the present invention, the term "(co)polymer" refers to a homopolymer and/or a copolymer.

In the present invention, the monomer (a) contained as an essential constituent monomer in the (co)polymer (A) is represented by the formula (1).

$R^1$ in the formula (1) is a hydrogen atom or a methyl group. Of these, a methyl group is preferred from the viewpoint of viscosity index improving effect.

In the formula (1), —$X^1$— is a group represented by —O— or —NH—.

$R^2$ in the formula (1) is a C2-C4 alkylene group. Examples of the C2-C4 alkylene group include an ethylene group, a 1,2- or 1,3-propylene group, and a 1,2-, 1,3-, or 1,4-butylene group. Of these, an ethylene group is preferred from the viewpoint of viscosity index improving effect.

The letter p is the number of moles of an alkylene oxide added, and it is an integer of 1 to 20. From the viewpoint of viscosity index improving effect, it is an integer of preferably 0 to 4, more preferably 0 to 2. Each $R^2$ may be the same as or different from each other when p is 2 or greater, and the $(R^2O)_p$ moiety may be bonded in a random form or a block form.

$R^3$ and $R^4$ are each independently a C8-C24 linear or branched alkyl group. Examples of the C8-C24 linear or branched alkyl group include linear alkyl groups (e.g., n-octyl, n-nonyl, n-decyl, n-undecyl, n-dodecyl, n-tridecyl, n-tetradecyl, n-pentadecyl, n-hexadecyl, n-heptadecyl, n-octadecyl, n-nonadecyl, n-eicosyl, n-heneicosyl, n-docosyl, n-tricosyl, and n-tetracosyl groups) and branched alkyl groups (e.g., isooctyl, 2-ethylhexyl, isononyl, 3,5,5-trimethylhexyl, 2,4,6-trimethylheptyl, 2-methylnonyl, isodecyl, 2-ethylnonyl, isoundecyl, isododecyl, 2-ethyldodecyl, 2-ethyltridecyl, 2-methyltetradecyl, isohexadecyl, 2-octylnonyl, 2-hexylundecyl, 2-ethylpentadecyl, 2-(3-methylhexyl)-7-methyl-nonyl, isooctadecyl, 1-hexyltridecyl, 2-ethylheptadecyl, isoicosyl, 1-octylpentadecyl, and 2-decyltetradecyl groups). Of these, from the viewpoint of viscosity index improving effect and shear stability, C8-C20 linear or branched alkyl groups are preferred, and C10-C18 linear or branched alkyl groups are more preferred.

From the viewpoint of viscosity index improving effect, the total carbon number of $R^3$ and $R^4$ is preferably 16 to 40, more preferably 20 to 38, particularly preferably 22 to 34.

From the viewpoint of viscosity index improving effect, the combination of the carbon numbers of $R^3$ and $R^4$ preferably satisfies the relationship of "the carbon number of $R^4$=the carbon number of $R^3$+2.

Specific examples of the monomer (a) include 2-n-octyldodecyl (meth)acrylate, 2-n-octyltetradecyl (meth)acrylate, and 2-n-decyltetradecyl (meth)acrylate, 2-n-dodecylhexadecyl (meth)acrylate, 2-n-tetradecyloctadecyl (meth)acrylate, and 2-n-hexadecylicosyl (meth)acrylate.

The monomer (a) may include one or more monomers (a).

From the viewpoint of viscosity index improving effect, the monomer (a) is preferably 2-n-octyldodecyl (meth) acrylate, 2-n-decyltetradecyl (meth)acrylate, 2-n-dodecylhexadecyl (meth)acrylate, 2-n-tetradecyloctadecyl (meth) acrylate, or 2-n-hexadecylicosyl (meth)acrylate. The "(meth)acrylic acid" refers to acrylic acid and/or methacrylic acid.

In the present invention, preferably, the (co)polymer (A) is a copolymer further containing a (meth)acrylic acid alkyl ester (b) having a C1-C4 alkyl group (hereinafter also referred to as a monomer (b)), as a constituent monomer, from the viewpoint of viscosity index improving effect.

Examples of the (meth)acrylic acid alkyl ester (b) having a C1-C4 alkyl group include methyl (meth)acrylate, ethyl (meth)acrylate, n-propyl (meth)acrylate, isobutyl (meth) acrylate, and n-butyl (meth)acrylate.

The (meth)acrylic acid alkyl ester (b) is preferably methyl (meth)acrylate, ethyl (meth)acrylate, or n-butyl (meth)acrylate, particularly preferably methyl (meth)acrylate or n-butyl (meth)acrylate, from the viewpoint of viscosity index improving effect.

The monomer (b) may include one or more monomers (b).

In the present invention, the (co)polymer (A) may further contain at least one monomer, as a constituent monomer, selected from the group consisting of: a (meth)acrylic acid alkyl ester (c) having a C8-C18 alkyl group (hereinafter also referred to as a monomer (c)), which is other than the monomer (a); a nitrogen-containing monomer (d), which is other than the monomer (a); a hydroxy group-containing monomer (e); a phosphorus-containing monomer (f); an aromatic ring-containing vinyl monomer (g); a monomer (h) having two or more unsaturated groups; a vinyl compound (i) (hereinafter also referred to as a monomer (i)); an epoxy group-containing monomer (j); a halogen-containing monomer (k); and an unsaturated polycarboxylic acid ester (l) (hereinafter also referred to as a monomer (l)).

Examples of the C8-C18 alkyl group of the (meth)acrylic acid alkyl ester (c) include linear alkyl groups (e.g., n-octyl, n-nonyl, n-decyl, n-undecyl, n-dodecyl, n-tridecyl, n-tetradecyl, n-pentadecyl, n-hexadecyl, n-heptadecyl, and n-octadecyl groups), branched alkyl groups (e.g., isooctyl, 2-ethylhexyl, isononyl, 3,5,5-trimethylhexyl, 2,4,6-trimethylheptyl, 2-methylnonyl, isodecyl, 2-ethylnonyl, isoundecyl, isododecyl, 2-ethyldodecyl, 2-ethyltridecyl, and 2-methyltetradecyl groups).

Specific examples of the (meth)acrylic acid alkyl ester (c) having a C8-C18 alkyl group include n-octyl (meth)acrylate, 2-ethylhexyl (meth)acrylate, n-decyl (meth)acrylate, n-dodecyl (meth)acrylate, 2-methylundecyl (meth)acrylate, n-tridecyl (meth)acrylate, 2-methyldodecyl (meth)acrylate, n-tetradecyl (meth)acrylate, 2-methyltridecyl (meth)acrylate, n-pentadecyl (meth)acrylate, 2-methyltetradecyl (meth) acrylate, n-hexadecyl (meth)acrylate, n-heptadecyl (meth) acrylate, and n-octadecyl (meth)acrylate.

From the viewpoint of viscosity index improving effect, the monomer (c) is preferably a (meth)acrylic acid alkyl ester having a C10-C18 alkyl group, more preferably a (meth)acrylic acid alkyl ester having a C10-C18 linear alkyl group, particularly preferably a (meth)acrylic acid alkyl ester having a C10-C16 linear alkyl group.

The monomer (c) may include one or more monomers (c).

Examples of the nitrogen-containing monomer (d) include the following monomers (d1) to (d4) excluding the monomer (a).

Amide Group-Containing Monomer (d1)

Examples include (meth)acrylamides; monoalkyl (meth) acrylamides (those in which one C1-C4 alkyl group is bonded to a nitrogen atom, such as N-methyl (meth)acrylamide, N-ethyl (meth)acrylamide, N-isopropyl (meth)acrylamide, N-n-butyl (meth)acrylamide, and N-isobutyl (meth) acrylamide); N—(N'-monoalkylaminoalkyl) (meth) acrylamides (those having an aminoalkyl group (C2-C6) in which one C1-C4 alkyl group is bonded to a nitrogen atom, such as N—(N'-methylaminoethyl) (meth)acrylamide, N—(N'-ethylaminoethyl) (meth)acrylamide, N—(N'-isopropylamino-n-butyl) (meth)acrylamide, N—(N'-n-butylamino-n-butyl) (meth)acrylamide, and N—(N'-isobutylamino-n-butyl) (meth)acrylamide); dialkyl (meth) acrylamides (those in which two C1-C4 alkyl groups are bonded to a nitrogen atom, such as N,N-dimethyl (meth) acrylamide, N,N-diethyl (meth)acrylamide, N,N-diisopropyl (meth)acrylamide, and N,N-di-n-butyl (meth)acrylamide); N—(N',N'-dialkylaminoalkyl) (meth)acrylamides (those having an aminoalkyl group (C2-C6) in which two C1-C4 alkyl groups are bonded to a nitrogen atom of an aminoalkyl group, such as N—(N',N'-dimethylaminoethyl) (meth)acrylamide, N—(N',N'-diethylaminoethyl) (meth) acrylamide, N—(N',N'-dimethylaminopropyl) (meth)acrylamide, and N—(N',N'-di-n-butylaminobutyl) (meth)acrylamide); and N-vinyl carboxylic acid amides (e.g., N-vinylformamide, N-vinylacetamide, N-vinyl propionic acid amide, and N-vinylhydroxyacetamide).

Nitro Group-Containing Monomer (d2)

An example is 4-nitrostyrene.

Primary, Secondary, or Tertiary Amino Group-Containing Monomer (d3)

Examples include primary amino group-containing monomers such as C3-C6 alkenylamines (e.g., (meth)allylamine and crotylamine) and aminoalkyl (C2-C6) (meth) acrylates (e.g., aminoethyl (meth)acrylate); secondary amino group-containing monomers such as monoalkylaminoalkyl (meth)acrylates (e.g., those having an aminoalkyl group (C2-C6) in which one C1-C6 alkyl group is bonded to the nitrogen atom, such as N-t-butylaminoethyl (meth)acrylate and N-methylaminoethyl (meth)acrylate), and C6-C12 dialkenylamines (e.g., di(meth)allylamine); tertiary amino group-containing monomers such as dialkylaminoalkyl (meth)acrylates (e.g., those having an aminoalkyl group (C2-C6) in which two C1-C6 alkyl groups are bonded to the nitrogen atom, such as N,N-dimethyiaminoethyl (meth) acrylate and N,N-diethyiaminoethyl (meth)acrylate), nitrogen-containing alicyclic (meth)acrylates (e.g., morpholinoethyl (meth)acrylate), aromatic monomers (e.g., N— (N',N'-diphenylaminoethyl) (meth)acrylamide, N,N-dimethylaminostyrene, 4-vinylpyridine, 2-vinylpyridine, N-vinylpyrrole, N-vinylpyrrolidone, and N-vinylthiopyrrolidone); and hydrochlorides, sulfates, phosphates, and salts of lower alkyl (C1-C8) monocarboxylic acids (e.g., acetic acid and propionic acid) of these.

Nitrile Group-Containing Monomer (d4)

An example is (meth)acrylonitrile.

The nitrogen-containing monomer (d) is preferably the amide group-containing monomer (d1) or the primary, secondary, or tertiary amino group-containing monomer (d3), more preferably N—(N',N'-diphenylaminoethyl) (meth) acrylamide, N—(N',N'-dimethylaminoethyl) (meth)acrylamide, N—(N',N'-diethylaminoethyl) (meth)acrylamide, N—(N',N'-dimethylaminopropyl) (meth)acrylamide, N,N-dimethylaminoethyl (meth)acrylate, or N,N-diethylaminoethyl (meth)acrylate.

The monomer (d) may include one or more monomers (d).

Hydroxy Group-Containing Monomer (e)

Examples include: hydroxy group-containing aromatic monomers (e.g., p-hydroxystyrene); (meth)acrylic acid hydroxyalkyls (the carbon number of the hydroxyalkyl group is 2 to 6) (e.g., 2-hydroxyethyl (meth)acrylate, 2- or 3-hydroxypropyl (meth)acrylate, 2-hydroxybutyl (meth) acrylate, 2-hydroxyisobutyl (meth)acrylate); mono- or bis-hydroxyalkyl (C1-C4) substituted (meth)acrylamides (e.g., N,N-bis(hydroxymethyl) (meth)acrylamide, N,N-bis(hydroxypropyl) (meth)acrylamide, and N,N-bis(2-hydroxybutyl) (meth)acrylamide); vinyl alcohol; C3-C12 alkenols (e.g., (meth)allyl alcohol, crotyl alcohol, isocrotyl alcohol, 1-octenol, and 1-undecenol); C4-C12 alkene monools or alkene diols (e.g., 1-buten-3-ol, 2-buten-1-ol, and 2-butene-1,4-diol); hydroxyalkyl (C1-C6) alkenyl (C3-C10) ethers (e.g., 2-hydroxyethylpropenyl ether); and alkenyl (C3-C10) ethers or (meth)acrylates of polyhydric (tri- to octahydric) alcohols (e.g., glycerol, pentaerythritol, sorbitol, sorbitan, diglycerol, sugars, and sucrose) (e.g., (meth)allylether of sucrose).

Examples also include mono(meth)acrylates of polyoxyalkylene glycols (the carbon number of the alkylene group is 2 to 4; the polymerization degree is 2 to 50), polyoxyalkylene polyols (e.g., polyoxyalkylene ethers (the carbon number of the alkylene group is 2 to 4, the polymerization degree is 2 to 100) of the tri- to octahydric alcohols), or alkyl (C1-C4) ethers of polyoxyalkylene glycols or polyoxyalkylene polyols (e.g., polyethylene glycol (Mn: 100 to 300) mono(meth)acrylate, polypropylene glycol (Mn: 130 to 500) mono(meth)acrylate, methoxy polyethylene glycol (Mn: 110 to 310) (meth)acrylate, lauryl alcohol ethylene oxide adduct (2 to 30 moles) (meth)acrylate, and polyoxyethylene (Mn: 150 to 230) sorbitan mono(meth)acrylate).

The monomer (e) is preferably hydroxyalkyl (meth)acrylates in which the carbon number of the hydroxyalkyl group is 2 to 6, more preferably hydroxyalkyl (meth)acrylates in which the carbon number of the hydroxy alkyl group is 2 to 4, from the viewpoint of viscosity index improving effect.

Particularly preferred is 2-hydroxyethyl (meth)acrylate.

The monomer (e) may include one or more monomers (e)

Examples of the phosphorus-containing monomer (f) include the following monomers (f1) and (f2).

Phosphate ester group-containing monomer (f1) Examples include (meth)acryloyloxyalkyl (C2-C4) phosphate esters ((meth)acryloyloxyethyl phosphate and (meth) acryloyloxy isopropyl phosphate) and alkenyl phosphate esters (e.g., vinyl phosphate, allyl phosphate, propenyl phosphate, isopropenyl phosphate, butenyl phosphate, pentenyl phosphate, octenyl phosphate, decenyl phosphate, and dodecenyl phosphate). The term "(meth)acryloyloxy" refers to acryloyloxy and/or methacryloyloxy.

Phosphono Group-Containing Monomer (f2)

Examples include (meth)acryloyloxy alkyl (C2-C4) phosphonic acids (e.g., (meth)acryloyloxyethyl phosphonic acid) and alkenyl (C2-C12) phosphonic acids (e.g., vinylphosphonic acid, allylphosphonic acid, and octenylphosphonic acid).

The monomer (f) is preferably the monomer (f1), more preferably a (meth)acryloyloxyalkyl (C2-C4) phosphate ester, particularly preferably (meth)acryloyloxyethyl phosphate.

The monomer (f) may include one or more monomers (f).

Aromatic Ring-Containing Vinyl Monomer (g)

Examples include styrene, α-methylstyrene, vinyltoluene, 2,4-dimethylstyrene, 4-ethylstyrene, 4-isopropylstyrene, 4-butylstyrene, 4-phenylstyrene, 4-cyclohexylstyrene, 4-benzylstyrene, 4-crotylbenzene, indene, and 2-vinylnaphthalene.

The monomer (g) is preferably styrene or α-methylstyrene, more preferably styrene, from the viewpoint of viscosity index improving effect.

The monomer (g) may include one or more monomers (g).

Examples of the monomer (h) having two or more unsaturated groups include divinylbenzene, C4-C12 alkadienes (e.g., butadiene, isoprene, 1,4-pentadiene, 1,6-heptadiene, and 1,7-octadiene), (di)cyclopentadiene, vinylcyclohexene, ethylidenebicycloheptene, limonene, ethylene di(meth)acrylate, polyalkylene oxide glycol di(meth)acrylates, pentaerythritol triallyl ether, pentaerythritol tri(meth)acrylate, pentaerythritol tetra(meth)acrylate, trimethylolpropane tri (meth)acrylate, and esters disclosed in WO 01/009242 such as an ester of an unsaturated carboxylic acid having a Mn of 500 or more and glycol and an ester of an unsaturated alcohol and a carboxylic acid.

The monomer (h) may include one or more monomers (h).

Vinyl Compounds (e.g., Vinyl Esters, Vinyl Ethers, Vinyl Ketones) (i)

Examples include vinyl esters of C2-C12 saturated fatty acids (e.g., vinyl acetate, vinyl propionate, vinyl butyrate, and vinyl octanoate), C1-C12 alkyl, aryl, or alkoxyalkyl vinyl ethers (e.g., methyl vinyl ether, ethyl vinyl ether, propyl vinyl ether, butyl vinyl ether, 2-ethylhexyl vinyl ether, phenyl vinyl ether, vinyl-2-methoxyethyl ether, and vinyl-2-butoxyethyl ether), and C1-C8 alkyl or aryl vinyl ketones (e.g., methyl vinyl ketone, ethyl vinyl ketone, and phenyl vinyl ketone).

The monomer (i) may include one or more monomers (i).

Epoxy Group-Containing Monomer (j)

Examples include glycidyl (meth)acrylate and glycidyl (meth)allyl ether.

The monomer (j) may include one or more monomers (j).

Halogen-Containing Monomer (k)

Examples include vinyl chloride, vinyl bromide, vinylidene chloride, (meth)allyl chloride, and halogenated styrene (e.g., dichlorostyrene).

The monomer (k) may include one or more monomers (k).

Ester of Unsaturated Polycarboxylic Acid (1)

Examples include alkyl, cycloalkyl, or aralkyl esters of unsaturated polycarboxylic acids (C1-C8 alkyl diesters (dimethyl maleate, dimethyl fumarate, diethyl maleate, and dioctylmaleate) of unsaturated dicarboxylic acids (e.g., maleic acid, fumaric acid, and itaconic acid)).

The monomer (l) may include one or more monomers (l)

The weight average molecular weight (hereinafter abbreviated as Mw) and number average molecular weight (hereinafter abbreviated as Mn) of the (co)polymer (A) are determined by gel permeation chromatography (hereinafter abbreviated as GPC) under the conditions described below.

The Mw of the (co)polymer (A) is preferably 5,000 to 2,000,000, more preferably 5,000 to 700,000, still more preferably 10,000 to 600,000, particularly preferably 15,000 to 550,000, most preferably 18,000 to 500,000, from the viewpoint of viscosity index improving effect, low-temperature characteristics, and shear stability of the lubricant composition.

The (co)polymer (A) having a Mw of 5,000 or more results in excellent viscosity index improving effect, low-temperature characteristics, and shear stability of the lubricant composition. Also, the amount of the viscosity index improver composition added to the lubricant composition is appropriate. It is advantageous in terms of cost. The shear stability tends to be low as the Mw increases, while the shear stability tends to be high when the Mw is 2,000,000 or less.

The Mn of the (co)polymer (A) is preferably 2,500 or more, more preferably 5,000 or more, particularly preferably 7,500 or more, most preferably 15,000 or more. Meanwhile, the Mn is preferably 300,000 or less, more preferably 250,000 or less, particularly preferably 240,000 or less, most preferably 225,000 or less.

The (co)polymer (A) having an Mn of 2,500 or more results in excellent viscosity temperature characteristic improving effect and good viscosity index improving effect. Also, the amount of the viscosity index improver composition added to the lubricant composition is appropriate. It is advantageous in terms of cost. The (co)polymer (A) having an Mn of 300,000 or less tends to result in good shear stability.

<Conditions of Measurement of Mw and Mn of (Co)Polymer (A) by GPC>

Device: "HLC-8320GPC" (Tosoh Corporation)

Column: "TSKgel guard column Super HZM-M" (Tosoh Corporation), "TSKgel Super HZM-M" three columns (Tosoh Corporation)

Measurement temperature: 40° C.

Sample solution: 0.25 wt % solution in tetrahydrofuran

Volume of solution injected:10.0 μL

Detecting device: refractive index detector

Reference material: standard polystyrene (TS reference material: standard polystyrene (TSKstandard POLYSTYRENE) 12 samples (molecular weight: 589, 1,050, 2,630, 9,100, 19,500, 37,900, 96,400, 190,000, 355,000, 1,090,000, 2,110,000, 4,480,000) (Tosoh Corporation)

From the viewpoint of solubility in the lubricant, preferably, the (co)polymer (A) has a specific solubility parameter (hereinafter abbreviated as an SP value).

The (co)polymer (A) preferably has an SP value calculated based on the weight average of the (co)polymer (A) of 8.0 to 9.5 $(cal/cm^3)^{1/2}$. It is more preferably 8.5 to 9.5 $(cal/cm^3)^{1/2}$, particularly preferably 8.8 to 9.4 $(cal/cm^3)^{1/2}$, most preferably 8.9 to 9.3 $(cal/cm^3)^{1/2}$, from the viewpoint of viscosity index improving effect and solubility in the lubricant composition.

The SP value herein is calculated by the Fedors method (Polymer engineering and Science, February, 1974, Vol. 14, No. 2, pp. 147-154) using the numerical values (the energy of vaporization and the molar volume at 25° C. of atom or functional group) described on p. 152 (Table 5) and the equation (28) described on p. 153. Specifically, the SP value can be calculated by applying, to the following equation, the numerical values of the parameters of the Fedors method $\Delta e_i$ and $\Delta v_i$ shown in Table 1 below corresponding to the types of atoms and groups in the molecular structure.

$$\text{SP value}=(\Sigma\Delta e_i/\Delta\Delta v_i)^{1/2}$$

TABLE 1

| Atom or group | $\Delta e_i$ cal/mole | $\Delta v_i$ $cm^3$/mole |
|---|---|---|
| $CH_3$ | 1125 | 33.5 |
| $CH_2$ | 1180 | 16.1 |
| CH | 820 | −1.0 |
| C | 350 | −19.2 |
| $H_2C$═ | 1030 | 28.5 |
| —CH═ | 1030 | 13.5 |
| C═ | 1030 | −5.5 |
| HC═ | 920 | 27.4 |
| —C═ | 1690 | 6.5 |
| Phenyl* | 7630 | 71.4 |
| Phenylene (o, m, p)* | 7630 | 52.4 |
| Phenyl (trisubstituted)* | 7630 | 33.4 |
| Phenyl (tetrasubstituted)* | 7630 | 14.4 |
| Phenyl (pentasubstituted)* | 7630 | −4.6 |
| Phenyl (hexasubstituted)* | 7630 | −23.6 |
| Ring closure 5 or more atoms | 250 | 16 |
| Ring closure 3 or 4 atoms | 750 | 18 |
| Conjugation in ring for each double bond | 400 | −2.2 |
| Halogen attached to carbon atom with double bond | −20 percent of $\Delta e_i$ of halogen | 4.0 |
| $CO_3$ (carbonate) | 4200 | 22.0 |
| COOH | 6600 | 28.5 |
| $CO_2$ | 4300 | 18.0 |
| CO | 4150 | 10.8 |
| CHO (aldehyde) | 5100 | 22.3 |
| $CO_2CO_2$ (oxalate) | 6400 | 37.3 |
| $C_2O_3$ (anhydride) | 7300 | 30.0 |
| HCOO (formate) | 4300 | 32.5 |
| $CONH_2$ | 10000 | 17.5 |

TABLE 1-continued

| Atom or group | $\Delta e_i$ cal/mole | $\Delta v_i$ $cm^3$/mole |
|---|---|---|
| CONH | 8000 | 9.5 |
| CON | 7050 | −7.7 |
| HCON | 6600 | 11.3 |
| HCONH | 10500 | 27.0 |
| COCl | 5000 | 38.0 |
| $NH_2$ | 3000 | 19.2 |
| NH | 2000 | 4.5 |
| N | 1000 | −9.0 |
| —N= | 2800 | 5.0 |
| CN | 6100 | 24.0 |
| $NO_2$ (aliphatic) | 7000 | 24.0 |
| $NO_2$ (aromatic) | 3670 | 32.0 |
| $NO_3$ | 5000 | 33.5 |
| $NO_2$ (nitrite) | 2800 | 33.5 |
| SCN | 4800 | 37.0 |
| NCO | 6800 | 35.0 |
| $NF_2$ | 1830 | 33.1 |
| NF | 1210 | 24.5 |
| O | 800 | 3.8 |
| OH | 7120 | 10.0 |
| OH (disubstituted or on adjacent C atoms) | 5220 | 13.0 |
| $PO_4$ | 5000 | 28.0 |
| $PO_3$ | 3400 | 22.7 |
| SH | 3450 | 28.0 |
| S | 3380 | 12 |
| $S_2$ | 5700 | 23.0 |
| $SO_3$ | 4500 | 27.6 |
| $SO_4$ | 6800 | 31.6 |
| F | 1000 | 18.0 |
| F (disubstituted) | 850 | 20.0 |
| F (trisubstituted) | 550 | 22.0 |
| $CF_2$ (for perfluoro compounds) | 1020 | 23.0 |
| $CF_3$ (for perfluoro compounds) | 1020 | 57.5 |
| Cl | 2760 | 24.0 |
| Cl (disubstituted) | 2300 | 26.0 |
| Cl (trisubstituted) | 1800 | 27.3 |
| Br | 3700 | 30.0 |
| Br (disubstituted) | 2950 | 31.0 |
| Br (trisubstituted) | 2550 | 32.4 |
| I | 4550 | 31.5 |
| I (disubstituted) | 4000 | 33.3 |
| I (trisubstituted) | 3900 | 37.0 |
| B | 3300 | −2.0 |
| Al | 3300 | −2.0 |
| Ga | 3300 | −2.0 |
| In | 3300 | −2.0 |
| Tl | 3300 | −2.0 |
| Si | 810 | 0 |
| Ge | 1930 | −1.5 |
| Sn | 2700 | 1.5 |
| Pb | 4100 | 2.5 |
| P | 2250 | −1.0 |
| As | 3100 | 7.0 |
| Sb | 3900 | 8.9 |
| Bi | 5100 | 9.5 |
| Se | 4100 | 16.0 |
| Te | 4800 | 17.4 |
| Zn | 3460 | 2.5 |
| Cd | 4250 | 6.5 |
| Hg | 5450 | 7.5 |

The SP value calculated based on the weight average of the (co)polymer (A) refers to a value determined as follows: the SP values of the constituent units (each of which is a structure in which a vinyl group is converted into a single bond by a polymerization reaction) of the monomers constituting the (co)polymer (A) are calculated by the above-described method; and the SP values are arithmetically averaged based on the weight fractions of the corresponding constituent monomers at the time of addition. For example, in the case of methyl methacrylate as a monomer, the structural unit of methyl methacrylate consists of two $CH_3$ groups, one $CH_2$ group, one C, and one $CO_2$ group. Thus, the SP value of the structural unit derived from methyl methacrylate is determined from the following equations to be 9.933 $(cal/cm^3)^{1/2}$. Similarly, the SP value of the structural unit derived from ethyl methacrylate is calculated to be 9.721 $(cal/cm^3)^{1/2}$.

$$\Sigma\Delta e_i=1125\times2+1180+350+4300=8080$$

$$\Sigma\Delta v_i=33.5\times2+16.1-19.2+18.0=81.9$$

$$\delta=(8080/81.9)^{1/2}=9.933\ (cal/cm^3)^{1/2}$$

When the copolymer is a polymer of 50 wt % of methyl methacrylate and 50 wt % of ethyl methacrylate, the SP value of the copolymer is calculated by arithmetically averaging the SP values of the constituent units derived from the monomers as represented by the following equation.

$$\text{SP value of the copolymer}=9.933\times50+9.721\times50)/100=9.827$$

The SP value calculated based on the weight average of the (co)polymer (A) can be adjusted to 8.0 to 9.5 $(cal/cm^3)^{1/2}$ by appropriately controlling the monomers to be used and the weight fractions of the monomers.

From the viewpoint of viscosity index improving effect, the weight percentage of the monomer (a) constituting the (co)polymer (A) is preferably 10 to 90 wt %, more preferably 15 to 80 wt %, still more preferably 17.5 to 70 wt %, most preferably 20 to 60 wt %, based on the weight of the (co)polymer (A).

From the viewpoint of viscosity index improving effect, the weight percentage of the (meth)acrylic acid alkyl ester (b) having a C1-C4 alkyl group in the (co)polymer (A) is preferably 10 to 90 wt %, more preferably 15 to 80 wt %, particularly preferably 25 to 70 wt %, based on the weight of the (co)polymer (A).

From the viewpoint of viscosity index improving effect, the weight percentage of the (meth)acrylic acid alkyl ester (c) having a C8-C18 alkyl group in the (co)polymer (A) is preferably 0 to 80 wt %, more preferably 5 to 50 wt %, particularly preferably 5 to 45 wt %, based on the weight of the (co)polymer (A).

From the viewpoint of viscosity index improving effect, the weight percentage of the nitrogen-containing monomer (d) constituting the (co)polymer (A) is preferably 0.1 to 10 wt %, more preferably 1 to 7 wt %, particularly preferably 2 to 5 wt %, based on the weight of the (co) polymer (A).

From the viewpoint of viscosity index improving effect, the percentage of the hydroxy group-containing monomer (e) constituting the (co)polymer (A) is preferably 0 to 10 wt %, more preferably 1 to 7 wt %, particularly preferably 2 to 5 wt %, based on the weight of the (co)polymer (A).

From the viewpoint of viscosity index improving effect, the total weight percentage of the monomers (f) to (1) constituting the (co)polymer (A) is preferably 0 to 10 wt %, more preferably 1 to 7 wt %, particularly preferably 2 to 5 wt %, based on the weight of the (co)polymer (A).

The (co)polymer (A) can be obtained by a known production method. Specific examples include a method in which one or more of the monomers are solution-polymerized in a solvent in the presence of a polymerization catalyst.

Examples of the solvent include toluene, xylene, C9-C10 alkylbenzenes, methyl ethyl ketone, mineral oils, synthetic oils, and mixtures of these.

Examples of the polymerization catalyst include azo catalysts (e.g., 2,2'-azobis(2-methylbutyronitrile) and 2,2'-azobis(2,4-dimethylvaleronitrile)), peroxide catalysts (e.g., benzoyl peroxide, cumyl peroxide, and lauryl peroxide), and redox catalysts (e.g., mixtures of benzoyl peroxide and tertiary amines).

A known chain transfer agent (e.g., C2-C20 alkylmercaptans) can also be used in order to further adjust the molecular weight, if necessary.

The polymerization temperature is preferably 25° C. to 140° C., more preferably 50° C. to 120° C. The (co)polymer (A) can also be obtained by bulk polymerization, emulsion polymerization, or suspension polymerization other than the solution polymerization.

When the (co)polymer (A) is a copolymer, the polymerization form of the (co)polymer (A) may be a random addition polymer, an alternating copolymer, a graft copolymer, or a block copolymer.

The viscosity index improver composition of the present invention contains a C18-C40 chain aliphatic alcohol (B) (hereinafter also referred to as a chain aliphatic alcohol (B)).

The viscosity index improver composition containing the chain aliphatic alcohol (B) can be produced in a shorter time. The mechanism of this is presumably as follows. In the step of removing unreacted monomers during the production of the (co)polymer (A), the degree of decompression is required to be gradually increased over a long period of time so that bubbles do not overflow. The viscosity index improver composition of the present invention containing the chain aliphatic alcohol (B) in addition to the (co)polymer (A) enables the degree of decompression to increase in a short time and bubbles generated by the vaporization of unreacted monomers to be quickly raised above the oil surface. Thereby, the production time of the viscosity index improver composition can be reduced.

The viscosity index improver composition of the present invention containing the chain aliphatic alcohol (B) can impart antifoaming properties to the lubricant composition without changing the viscosity index improving effect of the (co)polymer (A). Also, the lubricant composition has excellent persistence of the antifoaming properties even after the lubricant composition is subjected to long-term operation in practical use.

From the viewpoint of compatibility between the chain aliphatic alcohol (B) and the copolymer (A), the absolute value of the difference in SP value between the copolymer (A) and the chain aliphatic alcohol (B) is preferably 0.01 to 0.5 $(cal/cm^3)^{1/2}$, more preferably 0.01 to 0.4 $(cal/cm^3)^{1/2}$.

The SP value of the chain aliphatic alcohol (B) can be calculated using the molecular structure and the parameters of the Fedors method.

The chain aliphatic alcohol (B) preferably has an HLB value of 0.1 to 4.0, more preferably 0.2 to 3.0, from the viewpoint of antifoaming properties. A chain aliphatic alcohol (B) having a HLB value within the above range has excellent solubility in base oils and the (co)polymer (A) and tends to provide a lubricant composition having good antifoaming properties and good persistence of the antifoaming properties. The HLB value of the chain aliphatic alcohol (B) can be calculated by the Griffin method using the following equation.

HLB value=20×[number of hydroxy groups×17 (formula weight)]/[molecular weight of chain aliphatic alcohol (*B*)]

Examples of the chain aliphatic alcohol (B) include: linear saturated aliphatic monoalcohols such as primary monoalcohols (e.g., 1-octadecanol, 1-nonadecanol, 1-icosanol, 1-docosanol, 1-tetracosanol, 1-hexacosanol, 1-octacosanol, 1-triacontanol, 1-dotriacontanol, 1-tetratriacontanol, and 1-hexatriacontanol) and secondary monoalcohols (e.g., 2-, 3-, 4-, 5-, 6-, 7-, 8-, or 9-octadecanol and 2-, 3-, 4-, 5-, 6-, 7-, 8-, 9-, or 10-icosanol); branched chain saturated aliphatic monoalcohols such as primary monoalcohols (e.g., 2-alkyl (the carbon number of the alkyl group is 1 to 16) substituted alkyl-1-ols (the carbon number of the alkyl group is 12 to 30) (e.g., 2-methyl heptadecan-1-ol, 2-methyloctadecan-1-ol, 2,6-dimethyloctadecan-1-ol, 2,6,10,14-tetramethylheptadecan-1-ol, 2-octyl-1-dodecanol, 2-octyl-1-tetradecanol, 2-decyl-1-tetradecanol, 2-dodecyl-1-hexadecanol, 2-tetradecyl-1-octadecanol, 2-hexadecyl-1-eicosanol, and 2-isohexa-1-triacontanol)), secondary monoalcohols (e.g., 3,7-dimethylheptacosan-2-ol and 3,7,15-trimethylheptacosan-2-ol), and tertiary monoalcohols; linear unsaturated aliphatic monoalcohols such as oleyl alcohol and erucyl alcohol; branched unsaturated aliphatic monoalcohols such as 3,7,11,15,19-pentamethyl-2-icosen-1-ol; and chain aliphatic alcohols having a valence of 2 or more.

Of these, from the viewpoint of antifoaming properties, C18-C40 linear saturated aliphatic monoalcohols and C18-C40 branched saturated aliphatic monoalcohols are preferred, C18-C40 branched saturated aliphatic monoalcohols are more preferred, C18-C40 branched saturated aliphatic primary monoalcohols are particularly preferred, and 2-alkyl (the carbon number of the alkyl group is 10 to 16) substituted alkyl-1-ols (the carbon number of the alkyl group is 12 to 18) are most preferred.

From the viewpoint of viscosity index improving effect, antifoaming properties, and persistence of the antifoaming properties, a combination of the monomer (a) in the (co)polymer (A) and the chain aliphatic alcohol (B) is preferably a combination of a monomer (a) represented by the formula (1) in which the total number of carbon atoms of $R^3$ and $R^4$ is 16 to 34, i.e., an (meth)acrylic acid alkyl ester as the monomer (a) in which the alkyl group portion has a carbon number of 18 to 36, and a chain aliphatic alcohol (B) in which the chain aliphatic group has a carbon number of 18 to 36.

The viscosity index improver composition of the present invention contains a base oil.

Non-limiting examples of the base oil include solvent-refined oils, highly hydrorefined oils, hydrocarbon-based synthetic lubricants, ester-based synthetic lubricants, and naphthenic oils.

From the viewpoint of viscosity index improving effect, the base oil preferably has a kinematic viscosity at 100° C. (measured according to ASTM D 445) of 1 to 15 $mm^2/s$, more preferably 1.2 to 5 $mm^2/s$.

The viscosity index of the base oil is calculated by the method of ASTM D2270 using the values of the kinematic viscosities at 40° C. and 100° C. determined by the method of ASTM D 445. The viscosity index of the base oil is preferably 90 or more, more preferably 100 or more, from the viewpoint of viscosity index improving effect.

The cloud point (measured according to JIS K 2269) of the base oil is preferably −5° C. or lower, more preferably −15° C. or lower. The base oil having a cloud point in this range tends to impart good low-temperature viscosity to the resulting lubricant composition.

The aniline point (measured according to JIS K 2256 (2013)) of the base oil is preferably 70° C. to 140° C., more preferably 90° C. to 130° C. The copolymer (A) and the chain aliphatic alcohol (B) are well soluble in a base oil having an aniline point within the above range, which tends to achieve excellent antifoaming properties and excellent persistence of the antifoaming properties.

From the viewpoint of the handleability, the viscosity index improving effect, and the shear stability of the viscosity index improver composition, the amount of the (co) polymer (A) in the viscosity index improver composition of the present invention is preferably 10 wt % or more, more preferably 16 wt % or more, while preferably 70 wt % or less, more preferably 60 wt % or less, based on the weight of the viscosity index improver composition. The amount of the (co)polymer (A) is preferably 10 to 70 wt %, more preferably 16 to 60 wt %.

From the viewpoint of reduction in the production time of the viscosity index improver composition and the antifoaming properties and the persistence of the antifoaming properties of the lubricant composition, the amount of the chain aliphatic alcohol (B) in the viscosity index improver composition of the present invention is preferably 0.01 wt % or more, more preferably 0.05 wt % or more, while preferably 5 wt % or less, more preferably 3 wt % or less, based on the weight of the viscosity index improver composition. In a preferred embodiment of the amount of the chain aliphatic alcohol (B), the amount is 0.01 to 5 wt %, more preferably 0.05 to 3 wt %. An amount of 5 wt % or less of the chain aliphatic alcohol (B) is appropriate when the chain aliphatic alcohol (B) is added to the lubricant composition. With such an amount, the viscosity characteristics (particularly low-temperature viscosity characteristics) of the lubricant composition are not adversely affected, and the lubricant composition tends to have excellent antifoaming properties.

From the viewpoint of the handleability of the viscosity index improver composition and the low-temperature viscosity of the resulting lubricant composition, the amount of the base oil in the viscosity index improver composition of the present invention is preferably 25 wt % or more, more preferably 37 wt % or more, while preferably 89.99 wt % or less, more preferably 79.95 wt % or less, based on the weight of the viscosity index improver composition. In a preferred embodiment of the amount of the base oil, the amount is 25 to 89.99 wt %, more preferably 37 to 79.95 wt %.

In the present invention, the weight ratio (A/B) of the (co)polymer (A) to the chain aliphatic alcohol (B) is preferably 10 to 10,000, more preferably 30 to 5,000, from the viewpoint of viscosity index improving effect, antifoaming properties, and persistence of the antifoaming properties.

A weight ratio (A/B) of the (co)polymer (A) to the chain aliphatic alcohol (B) in the viscosity index improver composition within the above range is preferred because the production time of the viscosity index improver composition can be reduced. Further, the weight ratio (A/B) of the (co)polymer (A) to the chain aliphatic alcohol (B) in the lubricant composition containing the viscosity index improver composition of the present invention tends to fall within the above range of the weight ratio. Thus, the lubricant composition tends to have a good viscosity index improving effect, good antifoaming properties, and good persistence of the antifoaming properties.

The amount of the chain aliphatic alcohol (B) in the viscosity index improver composition of the present invention or the lubricant composition of the present invention can be measured by the following method.

<Method for Measuring Amount of Chain Aliphatic Alcohol (B) in Viscosity Index Improver Composition or Lubricant Composition>

The viscosity index improver composition of the present invention or the lubricant composition of the present invention in an amount of 1 g is subjected to separation and extraction in a Soxhlet extractor with 300 ml of a hexane solvent. Thereby, the (co)polymer (A) component and other components soluble in hexane are separated from each other. The chain aliphatic alcohol (B), which is soluble in hexane, is included in the other components resulting from the extraction. The hexane solvent is removed from the solution containing the extracted other components under reduced pressure using an evaporator.

From an extract containing the other components in an amount of X (mg) left after the removal, a 10-mg portion is accurately weighed and combined with 40 mg of a silylating reagent (BSTFA-TMCS (99:1) available from Tokyo Kasei Kogyo Co., Ltd.), and they are reacted at 70° C. for three hours. The solution after the reaction is analyzed with a gas chromatograph mass spectrometer (GCMS). For example, in the case of the MS analysis of a C24 chain aliphatic alcohol (molecular weight: 355, molecular weight after silylation: 428), a peak of a molecular weight of 427 appears at a retention time of about 29.5 min in a gas chromatograph. Thus, the amount of the chain aliphatic alcohol (B) in the composition can be calculated from the amount of the viscosity index improver composition or lubricant composition used, the amount X of the extract containing the other components, and the peak area ratio.

<GC-MS Measurement Conditions>

(GC Measurement Conditions)

Apparatus: "GC-2010" (Shimadzu Corporation)

Column: ZB-5 (column length: 30 m, column inner diameter: 0.25 mm, film thickness: 0.25 μm) (SHIMADZU GLC Ltd.)

Vaporization chamber temperature: 250° C.

Pressure: 1000 kPa

Split ratio: 50

Temperature rising conditions: keep 40° C. for five min, heat up to 300° C. (10° C./min), and keep 300° C. for 10 min (MS measurement conditions)

Apparatus: GCMS QP-2010 Plus (Shimadzu Corporation)

Ion source: CI

Ion source temperature: 170° C.

Interface temperature: 250° C.

Introduced reagent gas: Isobutane

The lubricant composition of the present invention contains the viscosity index improver composition of the present invention, and at least one additive selected from the group consisting of a detergent, a dispersant, an antioxidant, an oiliness improver, a pour point depressant, a friction and wear modifier, an extreme pressure agent, a demulsifier, a metal deactivator, and a corrosion inhibitor.

From the viewpoint of viscosity index improving effect and shear stability, the lubricant composition of the present invention preferably contains the (co)polymer (A) in an amount of 0.1 wt % or more and 20 wt % or less based on the weight of the lubricant composition.

From the viewpoint of antifoaming properties and persistence of the antifoaming properties, the lubricant composition of the present invention preferably contains the chain aliphatic alcohol (B) in an amount of 0.001 wt % or more and 1.0 wt % or less based on the total weight of the lubricant composition. With an amount of 1.0 wt % or less of the chain aliphatic alcohol (B), the viscosity characteristics (particularly low-temperature viscosity characteristics) of the lubricant composition are not adversely affected, and the lubricant composition tends to have excellent antifoaming properties.

From the viewpoint of viscosity index, low-temperature viscosity, antifoaming properties, and persistence of the antifoaming properties, the lubricant composition of the present invention contains the base oil in an amount of 99.799 wt % or less, more preferably 99.599 wt % or less, while preferably 49 wt % or more, more preferably 59 wt % or more, based on the total weight of the lubricant composition.

From the viewpoint of viscosity index improving effect, antifoaming properties, and persistence of the antifoaming properties, in the lubricant composition of the present invention, the weight ratio (A/B) of the (co)polymer (A) to the chain aliphatic alcohol (B) is preferably 10 to 10,000, more preferably 30 to 5,000.

The lubricant composition of the present invention contains any of various additives. Examples of the additives include the followings.

(1) Detergent

Examples include basic, overbased, or neutral metal salts (e.g., overbased metal salts or alkaline earth metal salts of sulfonates such as petroleum sulfonate, alkylbenzene sulfonate, and alkylnaphthalene sulfonate), salicylates, phenates, naphthenates, carbonates, phosphonates, and mixtures of detergents.

(2) Dispersant

Examples include succinimides (bis- or mono-polybutenyl succinimides), Mannich condensates, and borates.

(3) Antioxidant

Examples include hindered phenols and aromatic secondary amines.

(4) Oiliness Improver

Examples include long-chain fatty acids and their esters (e.g., oleic acid and oleate esters), long-chain amines and their amides (e.g., oleylamine and oleylamide).

(5) Pour Point Depressant

Examples include polyalkylmethacrylates and ethylene-vinyl acetate copolymers.

(6) Friction and Wear Modifier

Examples include molybdenum-based compounds and zinc-based compounds (e.g., molybdenum dithiophosphate, molybdenum dithiocarbamate, and zinc dialkyldithiophosphate).

(7) Extreme Pressure Agent

Examples include sulfur-based compounds (mono- or disulfide, sulfoxide, and sulfur phosphide compounds), phosphide compounds, and chlorinated compounds (e.g., chlorinated paraffin).

(8) Demulsifier

Examples include quaternary ammonium salts (e.g., tetraalkyl ammonium salt), sulfonated oil and phosphates (e.g., phosphates of polyoxyethylene-containing nonionic surfactant), and hydrocarbon-based solvents (toluene, xylene, and ethyl benzene).

(9) Metal Deactivator

Examples include nitrogen-containing compounds (e.g., benzotriazole), nitrogen-containing chelate compounds (e.g., N,N'-disalicylidene-1,2-diaminopropane), and nitrogen/sulfur-containing compounds (e.g., 2-(n-dodecylthio) benzimidazole).

(10) Corrosion Inhibitor

Examples include nitrogen-containing compounds (e.g., benzotriazole and 1,3,4-thiadiazolyl-2,5-bis(dialkyldithiocarbamate)).

Only one of these additives may be added, or two or more additives may be added if necessary. A mixture of these additives may be referred to as a performance additive or a package additive, and such a mixture may be added.

Preferably, the amount of each of these additives is 0.1 to 15 wt % based on the total amount of the lubricant composition. The total amount of these additives is preferably 0.1 to 30 wt %, more preferably 0.3 to 20 wt %, based on the total amount of the lubricant composition.

The lubricant composition of the present invention is suitable for gear oil (e.g., differential fluid and industrial gear oil), MTF, transmission fluid (e.g., ATF, DCTF, and belt-CVTF), engine oils, traction fluid (e.g., Toroidal-CVTF), shock absorber oil, power steering fluid, hydraulic fluid (e.g., hydraulic fluid for construction machinery and industrial hydraulic fluid), or the like.

EXAMPLES

The present invention is described in detail below with reference to examples, but the present invention is not limited to these examples.

Examples 1 to 17 and Comparative Examples 2 to 4

A reaction vessel equipped with a stirring device, a heating and cooling device, a thermometer, a dropping funnel, a nitrogen inlet tube, and a pressure reducing device was charged with 100 parts by weight of base oil(s) shown in Table 2-1, Table 2-2, or Table 3 in amount(s) shown in the tables. Separately, a glass beaker was charged with chain aliphatic alcohol(s) (B) or a comparative compound (B'), a monomer blend, a chain transfer agent, and a polymerization initiator, shown in Table 2-1, Table 2-2, or Table 3 in amount(s) shown in the tables. The components were stirred and mixed at 20° C. to prepare a monomer solution, which was then poured into a dropping funnel. The gas phase in the reaction vessel was purged with nitrogen (gas phase oxygen concentration: 100 ppm), and then, the monomer solution was added dropwise thereto over three hours with the temperature in the system maintained at 70° C. to 85° C. under hermetically sealed conditions. The raw materials were added so that the liquid level of the reaction solution reached 70% of the volume of the reaction vessel. After completion of the dropwise addition, the mixture was aged at 90° C. for two hours and then heated to 120° C. Subsequently, the pressure was gradually reduced so that the degree of decompression reached 0.027 to 0.040 MPa at the same temperature and that the liquid level did not exceed 90% of the volume of the reaction vessel. Thereafter, unreacted monomers were removed until the bubble generation completely disappeared.

According to the above procedure, viscosity index improver compositions ($R^1$) to ($R^{17}$) and (S2) to (S4) each containing the (co)polymer (A) and the chain aliphatic alcohol(s) (B) or the comparative compound (B') were obtained. The Mw of each of copolymers (A1) to (A6) and (A'1) in the resulting viscosity index improver compositions and the amount of the chain aliphatic alcohol(s) (B) therein were measured by the above methods. The results and the times for removal of unreacted monomers were shown in Table 2-1, Table 2-2, or Table 3.

Examples 18 to 24 and Comparative Example 6

A reaction vessel equipped with a stirring device, a heating and cooling device, a thermometer, and a nitrogen inlet tube was charged with base oil(s) shown in Table 2-2 or Table 3 in amounts shown in the tables and the chain aliphatic alcohols (B), a monomer blend, and a polymerization initiator shown in Table 2-2 or Table 3 in amounts shown in the tables. The raw materials were added so that the liquid level of the reaction solution reached 70% of the volume of the reaction vessel. After purging with nitrogen (gas phase oxygen concentration: 100 ppm), the reaction solution was heated to 76° C. with stirring under hermetically sealed conditions, and the polymerization reaction was performed for four hours at this temperature. The mixture was heated to 120° C. Subsequently, the pressure was gradually reduced so that the degree of decompression reached 0.027 to 0.040 MPa at this temperature and that the liquid level did not exceed 90% of the volume of the reaction vessel. Thereafter, unreacted monomers were removed until the bubble generation completely disappeared.

According to the above procedure, viscosity index improver compositions (R18) to (R24) and (S6) each containing the (co)polymer (A) and the chain aliphatic alcohol(s) (B) were obtained. The Mw of each of copolymers (A7) to (A13) and (A'2) in the resulting viscosity index improver compositions, and the amount of the chain aliphatic alcohol(s) (B) therein were measured by the above methods. The results and the times for removal of unreacted monomers were shown in Table 2-2 or Table 3.

Comparative Example 1

A viscosity index improver composition (S1) containing the copolymer (A1) was obtained as in Example 1, except that the chain aliphatic alcohol (B) was not used. The Mw of the copolymer (A1) in the resulting viscosity index improver composition was measured by the above method. The result and the time of removal of unreacted monomers were shown in Table 3.

Comparative Example 5

A viscosity index improver composition (S5) containing the copolymer (A9) was obtained as in Example 20, except that the chain aliphatic alcohol (B) was not used. The Mw of the copolymer (A9) in the resulting viscosity index improver composition was measured by the above method. The result and the time of removal of unreacted monomers were shown in Table 3.

TABLE 2-1

| | | Example | | | | | | | | | | | |
|---|---|---|---|---|---|---|---|---|---|---|---|---|---|
| | | 1 | 2 | 3 | 4 | 5 | 6 | 7 | 8 | 9 | 10 | 11 | 12 |
| | Viscosity index improver composition | (R1) | (R2) | (R3) | (R4) | (R5) | (R6) | (R7) | (R8) | (R9) | (R10) | (R11) | (R12) |
| | (Co)polymer (A) | (A1) | (A1) | (A1) | (A1) | (A1) | (A1) | (A1) | (A2) | (A3) | (A4) | (A5) | (A5) |
| Base oil (wt %) | Base oil 1: YUBASE 2 (kinematic viscosity at 100° C. = 2.4 $mm^2/s$) | 100 | 100 | 100 | 100 | 100 | 100 | 100 | — | — | — | 100 | — |
| | Base oil 2: Ultra-S2 (kinematic viscosity at 100° C. = 2.3 $mm^2/s$) | — | — | — | — | — | — | — | — | 100 | 100 | — | — |
| | Base oil 3: YUBASE 4 (kinematic viscosity at 100° C. = 4.2 $mm^2/s$) | — | — | — | — | — | — | — | — | — | — | — | — |
| | Base oil 4: Dianafrecia W-8 (kinematic viscosity at 100° C. = 2.3 $mm^2/s$) | — | — | — | — | — | — | — | 50 | — | — | — | — |
| | Base oil 5: Mineral oil (kinematic viscosity at 100° C. = 1.5 $mm^2/s$) | — | — | — | — | — | — | — | 50 | — | — | — | — |
| | Base oil 6: GTL oil (kinematic viscosity at 100° C. = 1.3 $mm^2/s$) | — | — | — | — | — | — | — | — | — | — | — | 40 |
| | Base oil 7: GTL oil (kinematic viscosity at 100° C. = 2.0 $mm^2/s$) | — | — | — | — | — | — | — | — | — | — | — | 60 |
| | Base oil 8: GTL oil (kinematic viscosity at 100° C. = 2.7 $mm^2/s$) | — | — | — | — | — | — | — | — | — | — | — | — |
| | Base oil 9: GTL oil (kinematic viscosity at 100° C. = 4.1 $mm^2/s$) | — | — | — | — | — | — | — | — | — | — | — | — |
| | Amount added (parts by weight) | 100 | 100 | 100 | 100 | 100 | 100 | 100 | 80 | 135 | 100 | 145 | 140 |
| Constituent monomers of copolymer (A) (wt %) | (a-1) 2-n-Decyltetradecyl methacrylate | 15.0 | 15.0 | 15.0 | 15.0 | 15.0 | 15.0 | 15.0 | 27.0 | 33.5 | — | — | |
| | (a-2) 2-n-Dodecylhexadecyl methacrylate | — | — | — | — | — | — | — | — | — | 27.8 | 28.0 | 28.0 |
| | (a-3) 2-n-Tetradecyloctadecyl methacrylate | — | — | — | — | — | — | — | — | — | 27.7 | 28.0 | 28.0 |
| | (a-4) 2-n-Hexadecylicosyl methacrylate | 26.0 | 26.0 | 26.0 | 26.0 | 26.0 | 26.0 | 26.0 | — | — | — | — | — |
| | (b-1) Methyl methacrylate | 20.5 | 20.5 | 20.5 | 20.5 | 20.5 | 20.5 | 20.5 | 38.0 | 38.0 | 44.5 | 44.0 | 44.0 |
| | (b-2) n-Butyl methacrylate | — | — | — | — | — | — | — | — | — | — | — | — |
| | (c-1) n-Dodecyl methacrylate | 14.1 | 14.1 | 14.1 | 14.1 | 14.1 | 14.1 | 14.1 | — | — | — | — | — |
| | (c-2) Methacrylic acid esterified product of Neodol 23 | 0.4 | 0.4 | 0.4 | 0.4 | 0.4 | 0.4 | 0.4 | 5.0 | 0.1 | — | — | — |
| | (c-3) Methacrylic acid esterified product of Neodol 45 | — | — | — | — | — | — | — | — | 0.1 | — | — | — |
| | (c-4) n-Hexadecyl methacrylate | — | — | — | — | — | — | — | 21.0 | 19.8 | — | — | — |
| | (c-5) n-Octadecyl methacrylate | 24.0 | 24.0 | 24.0 | 24.0 | 24.0 | 24.0 | 24.0 | 9.0 | 8.5 | — | — | — |
| | (d-1) N,N-Dimethylaminoethyl methacrylate | — | — | — | — | — | — | — | — | — | — | — | — |
| | (d-2) N,N-Diethylaminoethyl methacrylate | — | — | — | — | — | — | — | — | — | — | — | — |
| | (e-1) 2-Hydroxyethyl acrylate | — | — | — | — | — | — | — | — | — | — | — | — |
| | (e-2) 2-Hydroxyethyl methacrylate | — | — | — | — | — | — | — | — | — | — | — | — |
| | Total | 100 | 100 | 100 | 100 | 100 | 100 | 100 | 100 | 100 | 100 | 100 | 100 |
| | Amount added (parts by weight) | 99.99 | 99.98 | 99.90 | 99.10 | 97.02 | 99.90 | 99.90 | 119.14 | 64.45 | 98.90 | 54.38 | 59.33 |
| Chain aliphatic alcohol (B) (wt %) | (B1) Stearyl alcohol | — | — | — | — | — | — | 40 | 25 | 20 | — | — | — |
| | (B2) 2-Decyl-1-tetradecanol | 100 | 100 | 100 | 100 | 100 | — | 20 | 75 | 80 | — | — | — |
| | (B3) 2-Dodecyl-1-hexadecanol | — | — | — | — | — | — | — | — | — | 50 | 50 | 50 |
| | (B4) 2-Tetradecyl-1-octadecanol | — | — | — | — | — | — | — | — | — | 50 | 50 | 50 |
| | (B5) 2-Isohexa-1-triacontanol | — | — | — | — | — | 100 | 40 | — | — | — | — | — |
| | (B1') Polydimethylsiloxane | — | — | — | — | — | — | — | — | — | — | — | — |
| | (B2') Lauryl alcohol | — | — | — | — | — | — | — | — | — | — | — | — |
| | Total | 100 | 100 | 100 | 100 | 100 | 100 | 100 | 100 | 100 | 100 | 100 | 100 |
| | Amount added (parts by weight) | 0.01 | 0.02 | 0.10 | 0.90 | 2.98 | 0.10 | 0.10 | 0.86 | 0.55 | 1.10 | 0.62 | 0.67 |
| Chain transfer agent | X-1: Dodecyl mercaptan (parts by weight) | 0.80 | 0.80 | 0.80 | 0.80 | 0.80 | 0.80 | 0.80 | 0.95 | 0.03 | 0.84 | 0.08 | 0.09 |
| Polymerization initiator | Z-1: 2,2'-Azobis (2,4-dimethylvaleronitrile) (parts by weight) | 0.50 | 0.50 | 0.50 | 0.50 | 0.50 | 0.50 | 0.50 | 0.60 | 0.03 | 0.49 | 0.03 | 0.03 |
| | Z-2: 2,2'-Azobis (2-methylbutyronitrile) (parts by weight) | — | — | — | — | — | — | — | — | 0.13 | — | 0.11 | 0.12 |
| | Mw ($\times 10^4$) of (co)polymer (A) | 3.0 | 3.0 | 3.0 | 3.0 | 3.0 | 3.0 | 3.0 | 3.0 | 20.0 | 3.6 | 11.0 | 11.0 |
| | SP value $(cal/cm^3)^{1/2}$ calculated based on weight fruction of (co)polymer (A) | 9.06 | 9.06 | 9.06 | 9.06 | 9.06 | 9.06 | 9.06 | 9.27 | 9.25 | 9.27 | 9.26 | 9.26 |
| | SP value $(cal/cm^3)^{1/2}$ of chain aliphatic alcohol (B) | 9.19 | 9.19 | 9.19 | 9.19 | 9.19 | 8.99 | 9.21 | 9.25 | 9.24 | 9.08 | 9.08 | 9.08 |

TABLE 2-1-continued

| | | Example | | | | | | | | | | | |
|---|---|---|---|---|---|---|---|---|---|---|---|---|---|
| | | 1 | 2 | 3 | 4 | 5 | 6 | 7 | 8 | 9 | 10 | 11 | 12 |
| Absolute value of difference in SP value between (A) and (B) | | 0.13 | 0.13 | 0.13 | 0.13 | 0.13 | 0.07 | 0.15 | 0.02 | 0.01 | 0.19 | 0.19 | 0.19 |
| Amount in viscosity index improver composition (wt %) | (Co)polymer (A) | 49.995 | 49.989 | 49.952 | 49.55 | 48.51 | 49.952 | 49.952 | 59.57 | 32.23 | 49.45 | 27.19 | 29.66 |
| | Chain aliphatic alcohol (B) | 0.005 | 0.011 | 0.048 | 0.45 | 1.49 | 0.048 | 0.048 | 0.43 | 0.27 | 0.55 | 0.31 | 0.34 |
| | Base oil | 50 | 50 | 50 | 50 | 50 | 50 | 50 | 40 | 67.5 | 50.00 | 72.5 | 70 |
| | Weight ratio (A/B) | 9999 | 4544 | 1041 | 110 | 33 | 1041 | 1041 | 138 | 118 | 90 | 88 | 88 |
| Time for removal of unreacted monomers | Time (h) required to reduce pressure to degree of decompression of 0.027 to 0.040 MPa | 1.0 | 1.0 | 1.0 | 0.9 | 0.5 | 1.0 | 1.0 | 0.9 | 0.9 | 0.8 | 0.9 | 0.9 |
| | Time (h) from when degree of decompression reached 0.027 to 0.040 MPa to when bubble generation completely disappeared | 1.5 | 1.5 | 1.5 | 1.4 | 1.0 | 1.5 | 1.5 | 1.4 | 1.4 | 1.3 | 1.4 | 1.4 |
| | Total time (h) for removal of unreacted monomers | 2.5 | 2.5 | 2.5 | 2.2 | 1.5 | 2.5 | 2.5 | 2.2 | 2.3 | 2.1 | 2.3 | 2.3 |

TABLE 2-2

| | | Example | | | | | | | | | | | |
|---|---|---|---|---|---|---|---|---|---|---|---|---|---|
| | | 13 | 14 | 15 | 16 | 17 | 18 | 19 | 20 | 21 | 22 | 23 | 24 |
| | Viscosity index improver composition | (R13) | (R14) | (R15) | (R16) | (R17) | (R18) | (R19) | (R20) | (R21) | (R22) | (R23) | (R24) |
| | (Co)polymer (A) | (A5) | (A5) | (A5) | (A5) | (A6) | (A7) | (A8) | (A9) | (A10) | (A11) | (A12) | (A13) |
| Base oil (wt %) | Base oil 1: YUBASE 2 (kinematic viscosity at 100° C. = 2.4 $mm^2/s$) | — | — | — | — | 100 | 100 | — | — | — | 40 | — | — |
| | Base oil 2: Ultra-S2 (kinematic viscosity at 100° C. = 2.3 $mm^2/s$) | — | — | — | 40 | — | — | — | — | 40 | — | — | — |
| | Base oil 3: YUBASE 4 (kinematic viscosity at 100° C. = 4.2 $mm^2/s$) | — | — | — | — | — | — | — | 100 | — | 60 | 100 | 75 |
| | Base oil 4: Dianafrecia W-8 (kinematic viscosity at 100° C. = 2.3 $mm^2/s$) | — | — | — | — | — | — | — | — | — | — | — | 25 |
| | Base oil 5: Mineral oil (kinematic viscosity at 100° C. = 1.5 $mm^2/s$) | — | — | — | — | — | — | — | — | — | — | — | — |
| | Base oil 6: GTL oil (kinematic viscosity at 100° C. = 1.3 $mm^2/s$) | 100 | — | — | 60 | — | — | — | — | — | — | — | — |
| | Base oil 7: GTL oil (kinematic viscosity at 100° C. = 2.0 $mm^2/s$) | — | 100 | — | — | — | — | — | — | 60 | — | — | — |
| | Base oil 8: GTL oil (kinematic viscosity at 100° C. = 2.7 $mm^2/s$) | — | — | 100 | — | — | — | — | — | — | — | — | — |
| | Base oil 9: GTL oil (kinematic viscosity at 100° C. = 4.1 $mm^2/s$) | — | — | — | — | — | — | 100 | — | — | — | — | — |
| | Amount added (parts by weight) | 140 | 140 | 140 | 140 | 140 | 140 | 160 | 162 | 130 | 162 | 160 | 158 |
| Constituent monomers of copolymer (A) (wt %) | (a-1) 2-n-Decyltetradecyl methacrylate | — | — | — | — | — | — | — | — | — | 33.2 | 30.5 | 32.5 |
| | (a-2) 2-n-Dodecylhexadecyl methacrylate | 28.0 | 28.0 | 28.0 | 28.0 | 25.5 | 28.0 | — | — | 15.6 | — | — | — |
| | (a-3) 2-n-Tetradecyloctadecyl methacrylate | 28.0 | 28.0 | 28.0 | 28.0 | 25.5 | 28.0 | — | — | 14.9 | — | — | — |
| | (a-4) 2-n-Hexadecylicosyl methacrylate | — | — | — | — | — | — | 45.7 | 45.7 | — | — | — | — |
| | (b-1) Methyl methacrylate | 44.0 | 44.0 | 44.0 | 44.0 | 49.0 | 44.0 | — | — | — | 35.5 | 35.5 | 33.0 |
| | (b-2) n-Butyl methacrylate | — | — | — | — | — | — | 35 | 10 | 35.7 | — | — | — |
| | (c-1) n-Dodecyl methacrylate | — | — | — | — | — | — | — | — | — | — | — | — |
| | (c-2) Methacrylic acid esterified product of Neodol 23 | — | — | — | — | — | — | 10.5 | 10.5 | 0.1 | 0.1 | 0.1 | 0.1 |
| | (c-3) Methacrylic acid esterified product of Neodol 45 | — | — | — | — | — | — | — | — | 0.1 | 0.1 | 0.1 | 0.1 |
| | (c-4) n-Hexadecyl methacrylate | — | — | — | — | — | — | — | 17.8 | 25.8 | 21.7 | 23.8 | 22.0 |
| | (c-5) n-Octadecyl methacrylate | — | — | — | — | — | — | — | 15.7 | 7.8 | 9.4 | 10.0 | 9.3 |
| | (d-1) N,N-Dimethylaminoethyl methacrylate | — | — | — | — | — | — | 2.9 | 0.1 | — | — | — | 1.5 |
| | (d-2) N,N-Diethylaminoethyl methacrylate | — | — | — | — | — | — | — | — | — | — | — | 1.5 |
| | (e-1) 2-Hydroxyethyl acrylate | — | — | — | — | — | — | 0.1 | 0.1 | — | — | — | — |
| | (e-2) 2-Hydroxyethyl methacrylate | — | — | — | — | — | — | 5.8 | 0.1 | — | — | — | — |
| | Total | 100 | 100 | 100 | 100 | 100 | 100 | 100 | 100 | 100 | 100 | 100 | 100 |
| | Amount added (parts by weight) | 59.33 | 59.33 | 59.33 | 59.33 | 59.39 | 59.33 | 39.83 | 37.83 | 69.83 | 37.68 | 39.68 | 41.65 |
| Chain aliphatic alcohol (B) (wt %) | (B1) Stearyl alcohol | — | — | — | — | — | — | — | — | — | 20 | 20 | 20 |
| | (B2) 2-Decyl-1-tetradecanol | — | — | — | — | — | — | — | — | — | 80 | 80 | 80 |
| | (B3) 2-Dodecyl-1-hexadecanol | 50 | 50 | 50 | 50 | 50 | 50 | — | — | 50 | — | — | — |
| | (B4) 2-Tetradecyl-1-octadecanol | 50 | 50 | 50 | 50 | 50 | 50 | 50 | 50 | 50 | — | — | — |
| | (B5) 2-Isohexa-1-triacontanol | — | — | — | — | — | — | 50 | 50 | — | — | — | — |
| | (B1') Polydimethylsiloxane | — | — | — | — | — | — | — | — | — | — | — | — |
| | (B2') Lauryl alcohol | — | — | — | — | — | — | — | — | — | — | — | — |
| | Total | 100 | 100 | 100 | 100 | 100 | 100 | 100 | 100 | 100 | 100 | 100 | 100 |
| | Amount added (parts by weight) | 0.67 | 0.67 | 0.67 | 0.67 | 0.61 | 0.67 | 0.17 | 0.17 | 0.17 | 0.32 | 0.32 | 0.35 |
| Chain transfer agent | X-1: Dodecyl mercaptan (parts by weight) | 0.09 | 0.09 | 0.09 | 0.09 | 0.09 | 0.09 | — | — | — | — | — | — |
| Polymerization initiator | Z-1: 2,2'-Azobis (2,4-dimethylvaleronitrile) (parts by weight) | 0.03 | 0.03 | 0.03 | 0.03 | 0.03 | 0.03 | 0.00 | 0.01 | — | 0.01 | — | 0.01 |
| | Z-2: 2,2'-Azobis (2-methylbutyronitrile) (parts by weight) | 0.12 | 0.12 | 0.12 | 0.12 | 0.12 | 0.12 | 0.08 | 0.12 | 0.10 | 0.11 | 0.05 | 0.08 |
| | Mw ($\times 10^4$) of (co)polymer (A) | 11.0 | 11.0 | 11.0 | 11.0 | 11.0 | 50.0 | 35.0 | 35.0 | 42.0 | 38.0 | 50.0 | 35.0 |
| | SP value $(cal/cm^3)^{1/2}$ calculated based on weight fruction of (co)polymer (A) | 9.26 | 9.26 | 9.26 | 9.26 | 9.32 | 9.26 | 9.30 | 8.89 | 9.05 | 9.23 | 9.23 | 9.22 |
| | SP value $(cal/cm^3)^{1/2}$ of chain aliphatic alcohol (B) | 9.08 | 9.08 | 9.08 | 9.08 | 9.08 | 9.08 | 9.02 | 9.02 | 9.08 | 9.24 | 9.24 | 9.24 |

TABLE 2-2-continued

| | | Example | | | | | | | | | | | |
|---|---|---|---|---|---|---|---|---|---|---|---|---|---|
| | | 13 | 14 | 15 | 16 | 17 | 18 | 19 | 20 | 21 | 22 | 23 | 24 |
| Absolute value of difference in SP value between (A) and (B) | | 0.19 | 0.19 | 0.19 | 0.19 | 0.25 | 0.19 | 0.29 | 0.13 | 0.02 | 0.01 | 0.01 | 0.02 |
| Amount in viscosity index improver composition (wt %) | (Co)polymer (A) | 29.66 | 29.66 | 29.66 | 29.66 | 29.69 | 29.66 | 19.92 | 18.92 | 34.92 | 18.84 | 19.84 | 20.82 |
| | Chain aliphatic alcohol (B) | 0.34 | 0.34 | 0.34 | 0.34 | 0.31 | 0.34 | 0.08 | 0.08 | 0.08 | 0.16 | 0.16 | 0.18 |
| | Base oil | 70 | 70 | 70 | 70 | 70 | 70 | 80 | 81 | 65 | 81 | 80 | 79 |
| | Weight ratio (A/B) | 88 | 88 | 88 | 88 | 97 | 88 | 237 | 225 | 416 | 116 | 122 | 119 |
| Time for removal of unreacted monomers | Time (h) required to reduce pressure to degree of decompression of 0.027 to 0.040 MPa | 0.9 | 0.9 | 0.9 | 0.9 | 0.9 | 0.9 | 1.0 | 1.0 | 1.0 | 0.9 | 0.9 | 0.9 |
| | Time (h) from when degree of decompression reached 0.027 to 0.040 MPa to when bubble generation completely disappeared | 1.4 | 1.4 | 1.4 | 1.4 | 1.4 | 1.4 | 1.5 | 1.5 | 1.5 | 1.4 | 1.4 | 1.4 |
| | Total time (h) for removal of unreacted monomers | 2.3 | 2.3 | 2.3 | 2.3 | 2.3 | 2.3 | 2.4 | 2.4 | 2.4 | 2.4 | 2.4 | 2.4 |

TABLE 3

| | | Comparative Example | | | | | |
|---|---|---|---|---|---|---|---|
| | | 1 | 2 | 3 | 4 | 5 | 6 |
| | Viscosity index improver composition | (S1) | (S2) | (S3) | (S4) | (S5) | (S6) |
| | (Co)polymer (A) | (A1) | (A1) | (A1) | (A'1) | (A9) | (A'2) |
| Base oil (wt %) | Base oil 1: YUBASE 2 (kinematic viscosity at 100° C. = 2.4 $mm^2/s$) | 100 | 100 | 100 | 100 | — | — |
| | Base oil 2: Ultra-S2 (kinematic viscosity at 100° C. = 2.3 $mm^2/s$) | — | — | — | — | — | — |
| | Base oil 3: YUBASE 4 (kinematic viscosity at 100° C. = 4.2 $mm^2/s$) | — | — | — | — | 100 | 100 |
| | Base oil 4: Dianafrecia W-8 (kinematic viscosity at 100° C. = 2.3 $mm^2/s$) | — | — | — | — | — | — |
| | Base oil 5: Mineral oil (kinematic viscosity at 100° C. = 1.5 $mm^2/s$) | — | — | — | — | — | — |
| | Base oil 6: GTL oil (kinematic viscosity at 100° C. = 1.3 $mm^2/s$) | — | — | — | — | — | — |
| | Base oil 7: GTL oil (kinematic viscosity at 100° C. = 2.0 $mm^2/s$) | — | — | — | — | — | — |
| | Base oil 8: GTL oil (kinematic viscosity at 100° C. = 2.7 $mm^2/s$) | — | — | — | — | — | — |
| | Base oil 9: GTL oil (kinematic viscosity at 100° C. = 4.1 $mm^2/s$) | — | — | — | — | — | — |
| | Amount added (parts by weight) | 100 | 100 | 100 | 100 | 162 | 162 |
| Constituent monomers of copolymer (A) (wt %) | (a-1) 2-n-Decyltetradecyl methacrylate | 15.0 | 15.0 | 15.0 | — | — | — |
| | (a-2) 2-n-Dodecylhexadecyl methacrylate | — | — | — | — | — | — |
| | (a-3) 2-n-Tetradecyloctadecyl methacrylate | — | — | — | — | — | — |
| | (a-4) 2-n-Hexadecylicosyl methacrylate | 26.0 | 26.0 | 26.0 | — | 45.7 | — |
| | (b-1) Methyl methacrylate | 20.5 | 20.5 | 20.5 | 20.5 | — | — |
| | (b-2) n-Butyl methacrylate | — | — | — | — | 10 | 10 |
| | (c-1) n-Dodecyl methacrylate | 14.1 | 14.1 | 14.1 | 14.1 | — | — |
| | (c-2) Methacrylic acid esterified product of Neodol 23 | 0.4 | 0.4 | 0.4 | 0.4 | 10.5 | 10.5 |
| | (c-3) Methacrylic acid esterified product of Neodol 45 | — | — | — | 41.0 | — | — |
| | (c-4) n-Hexadecyl methacrylate | — | — | — | — | 17.8 | 42.1 |
| | (c-5) n-Octadecyl methacrylate | 24.0 | 24.0 | 24.0 | 24.0 | 15.7 | 37.1 |
| | (d-1) N,N-Dimethylaminoethyl methacrylate | — | — | — | — | 0.1 | 0.1 |
| | (d-2) N,N-Diethylaminoethyl methacrylate | — | — | — | — | — | — |
| | (e-1) 2-Hydroxyethyl acrylate | — | — | — | — | 0.1 | 0.1 |
| | (e-2) 2-Hydroxyethyl methacrylate | — | — | — | — | 0.1 | 0.1 |
| | Total | 100 | 100 | 100 | 100 | 100 | 100 |
| | Amount added (parts by weight) | 100.00 | 99.99 | 99.99 | 99.99 | 38 | 37.83 |
| Chain aliphatic alcohol (B) (wt %) | (B1) Stearyl alcohol | — | — | — | — | — | — |
| | (B2) 2-Decyl-1-tetradecanol | — | — | — | 100 | — | — |
| | (B3) 2-Dodecyl-1-hexadecanol | — | — | — | — | — | — |
| | (B4) 2-Tetradecyl-1-octadecanol | — | — | — | — | — | 50 |
| | (B5) 2-Isohexa-1-triacontanol | — | — | — | — | — | 50 |
| | (B1') Polydimethylsiloxane | — | 100 | — | — | — | — |
| | (B2') Lauryl alcohol | — | — | 100 | — | — | — |
| | Total | — | 100 | 100 | 100 | — | 100 |
| | Amount added (parts by weight) | — | 0.01 | 0.01 | 0.01 | — | 0.17 |
| Chain transfer agent | X-1: Dodecyl mercaptan (parts by weight) | 0.80 | 0.80 | 0.80 | 0.80 | — | — |
| Polymerization initiator | Z-1: 2,2'-Azobis (2,4-dimethylvaleronitrile) (parts by weight) | 0.50 | 0.50 | 0.50 | 0.50 | 0.01 | 0.01 |
| | Z-2: 2,2'-Azobis (2-methylbutyronitrile) (parts by weight) | — | — | — | — | 0.12 | 0.12 |
| | Mw ($\times 10^4$) of (co)polymer (A) | 3.0 | 3.0 | 3.0 | 3.0 | 35.0 | 35.0 |
| | SP value $(cal/cm^3)^{1/2}$ calculated based on weight fruction of (co)polymer (A) | 9.06 | 9.06 | 9.06 | 9.14 | 8.89 | 8.98 |
| | SP value $(cal/cm^3)^{1/2}$ of chain aliphatic alcohol (B) | — | 7.40 | 9.81 | 9.19 | — | 9.02 |
| | Absolute value of difference in SP value between (A) and (B) | — | 1.66 | 0.75 | 0.05 | — | 0.04 |
| Amount in viscosity index improver composition (wt %) | (Co)polymer (A) | 50.00 | 49.995 | 49.995 | 49.995 | 19.00 | 18.92 |
| | Chain aliphatic alcohol (B) | — | 0.005 | 0.005 | 0.005 | — | 0.08 |
| | Base oil | 50 | 50 | 50 | 50 | 81 | 81 |
| | Weight ratio (A/B) | — | 9999 | 9999 | 9999 | — | 237 |
| Time for removal of unreacted monomers | Time (h) required to reduce pressure to degree of decompression of 0.027 to 0.040 MPa | 1.5 | 1.1 | 1.2 | 1.1 | 1.5 | 1.1 |
| | Time (h) from when degree of decompression reached 0.027 to 0.040 MPa to when bubble generation completely disappeared | 1.5 | 2.0 | 1.8 | 1.7 | 1.5 | 1.7 |
| | Total time (h) for removal of unreacted monomers | 3.0 | 3.1 | 3.0 | 2.8 | 3.0 | 2.8 |

The following describes the chain aliphatic alcohols (B), the comparative compounds (B'), the monomers (a) to (e), the chain transfer agent, the polymerization initiators, and the base oils shown in Table 2-1, Table 2-2, and Table 3.

(B1): Stearyl alcohol (1-octadecanol) (carbon number: 18), HLB value=1.26

(B2): 2-Decyl-1-tetradecanol (carbon number: 24), HLB value=0.96

(B3): 2-Dodecyl-1-hexadecanol (carbon number: 28), HLB value=0.83

(B4): 2-Tetradecyl-1-octadecanol (carbon number: 32), HLB value=0.73

(B5): 2-Isohexa-1-triacontanol (carbon number: 36), HLB value=0.65

(B1'): Polydimethylsiloxane (kinematic viscosity at 25° C.=10,000 $mm^2/s$)

(B2'): Lauryl alcohol (carbon number: 12), HLB value=3.82

(a-1): 2-n-Decyltetradecyl methacrylate (carbon number: 24)

(a-2): 2-n-Dodecylhexadecyl methacrylate (carbon number: 28)

(a-3): 2-n-Tetradecyloctadecyl methacrylate (carbon number: 32)

(a-4): 2-n-Hexadecylicosyl methacrylate (carbon number: 36)
(b-1): Methyl methacrylate (carbon number: 1)
(b-2): n-Butyl methacrylate (carbon number: 4)
(c-1): n-Dodecyl methacrylate (carbon number: 12)
(c-2): A blend of a C12-C13 linear alkyl methacrylate and a C12-C13 branched alkyl methacrylate (esterified product of Neodol 23 (Shell Chemicals) and methacrylic acid) (carbon number: 12 or 13)
(c-3): A blend of a C14-C15 linear alkyl methacrylate and a C14-C15 branched alkyl methacrylate (esterified product of Neodol 45 (Shell Chemicals) and methacrylic acid) (carbon number: 14 or 15)
(c-4): n-Hexadecyl methacrylate (carbon number: 16)
(c-5): n-Octadecyl methacrylate (carbon number: 18)
(d-1): N,N-Dimethylaminoethyl methacrylate
(d-2): N,N-Diethylaminoethyl methacrylate
(e-1): 2-Hydroxyethyl acrylate
(e-2): 2-Hydroxyethyl methacrylate Chain Transfer Agent
X-1: Dodecyl mercaptan Polymerization Initiator
Z-1: 2,2'-Azobis(2,4-dimethylvaleronitrile)
Z-2: 2,2'-Azobis(2-methylbutyronitrile)
Base oil 1: "YUBASE 2" available from SK LUBRICANTS CO., LTD. (kinematic viscosity at 100° C.=2.4 $mm^2/s$, viscosity index=96, aniline point=101.0° C.)
Base oil 2: "Ultra-S2" available from S-Oil (kinematic viscosity at 100° C.=2.3 $mm^2/s$, viscosity index=103, aniline point=101.8° C.
Base oil 3: "YUBASE 4" available from SK LUBRICANTS CO., LTD. (kinematic viscosity at 100° C.=4.2 $mm^2/s$, viscosity index=122, aniline point=117.4° C.)
Base oil 4: "Dianafrecia W-8" available from Idemitsu Showa Shell Co., Ltd. (kinematic viscosity at 100° C.=2.3 $mm^2/s$, viscosity index=83, aniline point=90.4° C.) Base oil 5: mineral oil (kinematic viscosity at 100° C.=1.5 $mm^2/s$)
Base oil 6: Gas to liquid (GTL) oil (kinematic viscosity at 100° C.=1.3 $mm^2/s$, aniline point=97° C.)
Base oil 7: GTL oil (kinematic viscosity at 100° C.=2.0 $mm^2/s$, aniline point=105° C.)
Base oil 8: GTL oil (kinematic viscosity at 100° C.=2.7 $mm^2/s$, viscosity index=118)
Base oil 9: GTL oil (kinematic viscosity at 100° C.=4.1 $mm^2/s$, viscosity index=126)

The results shown in Table 2-1, Table 2-2, and Table 3 show that the viscosity index improver compositions of the present invention have excellent antifoaming properties and can reduce the time of removal of unreacted monomers. In particular, comparison between Comparative Examples 1 to 3, which contain no chain aliphatic alcohols (B) or contain no chain aliphatic alcohols (B) but contain the comparative compound (B'), and Example 1, which is the same as Comparative Examples 1 to 3 except that Example 1 contains the chain aliphatic alcohol (B); and comparison between Comparative example 5 and Example 20 show that the presence of the chain aliphatic alcohols (B) in the production of the viscosity index improver compositions can achieve high antifoaming properties under reduced pressure and can reduce the time of removal of unreacted monomers. In addition, comparison between Comparative Example 4, which does not use the monomer (a), and Example 1, which is the same as Example 4 except that Example 1 uses the monomer (a); and comparison between Comparative Example 6 and Example 20 show that use of the (co)polymer (A) containing the monomer (a) as a constituent monomer and the chain aliphatic alcohol (B) enables reduction in the time of removal of unreacted monomers.

Examples 25 to 41 and Comparative Examples 7 to 10 (Evaluation of Lubricant Compositions)

In a stainless steel vessel equipped with a stirrer, a viscosity index improver composition in an amount shown in Table 4 was added to an additive-blended base oil, which had been obtained by dissolving 10 wt % of an additive 1 in the base oil 1. Thus, lubricant compositions having a kinematic viscosity at 100° C. of 5.00 $mm^2/s$ were prepared.

The shear stability, kinematic viscosity at 40° C., viscosity index, low-temperature viscosity (−40° C.), antifoaming properties, and persistence of the antifoaming properties of the lubricant compositions were measured by the following methods. Table 4 shows the results.

Examples 42 to 48 and Comparative Examples 11 and 12 (Evaluation of Lubricant Compositions)

In a stainless steel vessel equipped with a stirrer, a viscosity index improver composition in an amount shown in Table 5 was added to an additive-blended base oil, which had been obtained by adding 10 wt % of an additive 2 to the base oil 3. Thus, lubricant compositions having a HTHS viscosity at 150° C. of 2.6 mPa-s were prepared.

The high-temperature shear viscosity (HTHS viscosity (100° C.)), shear stability, kinematic viscosity at 100° C., kinematic viscosity at 40° C., viscosity index, low-temperature viscosity (−40° C.), antifoaming properties, and persistence of the antifoaming properties of the lubricant compositions were measured by the following methods. Table 5 shows the results.

Examples 49 to 55 and Comparative Examples 13 and 14 (Evaluation of Lubricant Compositions)

In a stainless steel vessel equipped with a stirrer, a viscosity index improver composition in an amount shown in Table 6 was added to an additive-blended base oil, which had been obtained by adding 10 wt % of the additive 2 to the base oil 3. Thus, lubricant compositions having a HTHS viscosity at 150° C. of 2.3 mPa-s were prepared.

The high-temperature shear viscosity (HTHS viscosity (100° C.)), shear stability, kinematic viscosity at 100° C., kinematic viscosity at 40° C., viscosity index, low-temperature viscosity (−40° C.), antifoaming properties, and persistence of the antifoaming properties of the lubricant compositions were measured by the following methods. Table 6 shows the results.

The following describes the additives shown in Tables 4 to 6.

(Additive 1): Additives including metal detergents (calcium sulfonate-based detergents having TBN of 300 mg KOH/g), ashless dispersants (succinimide), friction modifiers (oleylamide), antifriction agents (phosphoric acid), antioxidants (diphenylamine), metal deactivators (thiadiazoles), and sulfur additives (sulfurized esters)

(Additive 2): Package additive "P5741" available from Infineum

Base number=84 mg KOH/g, Calcium content=2.49%, Nitrogen content=0.68%, Phosphorus content=0.78%, Sulfated ash=9.76%, Zinc content=0.86% <Method for Calculating Viscosity Index of Lubricant Composition>

The kinetic viscosities at 40° C. and 100° C. were measured by the method of ASTM D 445, and the viscosity index was calculated by the method of ASTM D 2270. A greater value indicates a higher viscosity index improving effect.

<Methods for Measuring and Calculating Shear Stability (Sonic SS) of Lubricant Compositions>

The test was conducted according to the ultrasonic method of JPI-5S-29-2006. Examples 25 to 41 and Comparative Examples 7 to 10 were carried out by the high output method, and Examples 42 to 55 and Comparative Examples 11 to 14 were carried out by the low output method. A smaller value indicates a higher shear stability.

<Method for Measuring Low-Temperature Viscosity (−40° C.) of Lubricant Compositions>

The viscosity at −40° C. was measured by the method of JPI-5S-42-2004. A lower value indicates a lower low-temperature viscosity and higher low-temperature characteristics.

<Methods for Measuring and Calculating Shear Stability (BOSCH SS) of Lubricant Compositions>

The shear stability was measured by the method of ASTM D 6278 and calculated by the method of ASTM D 6022.

<Method for Measuring HTHS Viscosity of Lubricant Composition>

The HTHS viscosity was measured at 100° C. and 150° C. by the method of ASTM D 5481. A lower HTHS viscosity at 100° C. is better.

<Evaluation of Antifoaming Properties>

The lubricant compositions immediately after preparation were each evaluated by Sequence II (test temperature: 93.5° C.) according to the method of JIS-K 2518. The antifoaming properties of the lubricant compositions after the shear stability (Sonic SS) test were also evaluated in the same way. In addition, the thickness of the foam layer was evaluated immediately after the test and 10 min after the test according to the following criteria.

Immediately after the Test

Excellent: 15 ml or less

Very good: More than 15 ml and 30 ml or less

Good: More than 30 ml and 50 mL or less

Poor: More than 50 ml

10 Min after the Test

Good: Bubbles disappeared

Poor: Bubbles remained

TABLE 4

| | | | Example | | | | | | |
|---|---|---|---|---|---|---|---|---|---|
| | | | 25 | 26 | 27 | 28 | 29 | 30 | 31 |
| Viscosity index improver composition | | | (R1) | (R2) | (R3) | (R4) | (R5) | (R6) | (R7) |
| Amount added (parts by weight) | Viscosity index improver composition | | 17.9 | 17.9 | 18.0 | 18.1 | 18.5 | 18.0 | 18.0 |
| | Additive-blended base oil (10 wt % of additive 1 is added to base oil 1) | | 82.1 | 82.1 | 82.0 | 81.9 | 81.5 | 82.0 | 82.0 |
| Lubricant composition | | | (V1) | (V2) | (V3) | (V4) | (V5) | (V6) | (V7) |
| Amount (wt %) of copolymer (A) in lubricant composition | | | 8.97 | 8.97 | 8.97 | 8.97 | 8.97 | 8.97 | 8.97 |
| Amount (wt %) of chain aliphatic alcohol (B) in lubricant composition | | | 0.001 | 0.002 | 0.009 | 0.081 | 0.276 | 0.009 | 0.009 |
| Weight ratio (A/B) in lubricant composition | | | 9999 | 4544 | 1041 | 110 | 33 | 1041 | 1041 |
| Kinematic viscosity at 100° C. ($mm^2/s$) | | | 5.00 | 5.00 | 5.00 | 5.00 | 5.00 | 5.00 | 5.00 |
| Kinematic viscosity at 40° C. ($mm^2/s$) | | | 18.1 | 18.1 | 18.1 | 18.1 | 18.1 | 18.1 | 18.1 |
| Viscosity index | | | 228 | 228 | 228 | 228 | 228 | 228 | 228 |
| Shear stability (%) (Sonic SS) | | | 2.8 | 2.8 | 2.8 | 2.8 | 2.8 | 2.8 | 2.8 |
| Low-temperature viscosity (mPa · s) | | | 3300 | 3300 | 3300 | 3300 | 3300 | 3300 | 3300 |
| Antifoaming properties | Immediately after preparation | Immediately after test | Good | Good | Very good | Very good | Excellent | Very good | Very good |
| | | 10 min after test | Good | Good | Good | Good | Good | Good | Good |
| Persistence of antifoaming properties | After shear stability test | Immediately after test | Good | Good | Very good | Very good | Excellent | Very good | Very good |
| | | 10 min after test | Good | Good | Good | Good | Good | Good | Good |

| | | | Example | | | | | | |
|---|---|---|---|---|---|---|---|---|---|
| | | | 32 | 33 | 34 | 35 | 36 | 37 | 38 |
| Viscosity index improver composition | | | (R8) | (R9) | (R10) | (R11) | (R12) | (R13) | (R14) |
| Amount added (parts by weight) | Viscosity index improver composition | | 16.1 | 13.0 | 18.4 | 25.0 | 25.6 | 26.6 | 24.3 |
| | Additive-blended base oil (10 wt % of additive 1 is added to base oil 1) | | 83.9 | 87.0 | 81.6 | 75.0 | 74.4 | 73.4 | 75.7 |
| Lubricant composition | | | (V8) | (V9) | (V10) | (V11) | (V12) | (V13) | (V14) |
| Amount (wt %) of copolymer (A) in lubricant composition | | | 9.60 | 4.20 | 9.10 | 6.80 | 7.60 | 7.90 | 7.20 |
| Amount (wt %) of chain aliphatic alcohol (B) in lubricant composition | | | 0.070 | 0.036 | 0.102 | 0.077 | 0.086 | 0.089 | 0.082 |
| Weight ratio (A/B) in lubricant composition | | | 138 | 118 | 89 | 88 | 88 | 88 | 88 |
| Kinematic viscosity at 100° C. ($mm^2/s$) | | | 5.00 | 5.00 | 5.00 | 5.00 | 5.00 | 5.00 | 5.00 |
| Kinematic viscosity at 40° C. ($mm^2/s$) | | | 17.6 | 16.2 | 17.4 | 16.9 | 15.72 | 15.55 | 15.80 |
| Viscosity index | | | 239 | 274 | 243 | 261 | 288 | 293 | 285 |

TABLE 4-continued

| | | | | | | | | | |
|---|---|---|---|---|---|---|---|---|---|
| Shear stability (%) (Sonic SS) | | | 2.6 | 19.1 | 3.5 | 13.1 | 15.3 | 15.5 | 15.2 |
| Low-temperature viscosity (mPa · s) | | | 3200 | 3000 | 2900 | 3400 | 3800 | 3900 | 3500 |
| Antifoaming properties | Immediately after preparation | Immediately after test | Very good | Very good | Very good | Very good | Very good | Very good | Very good |
| | | 10 min after test | Good | Good | Good | Good | Good | Good | Good |
| Persistence of antifoaming properties | After shear stability test | Immediately after test | Very good | Very good | Very good | Very good | Very good | Very good | Very good |
| | | 10 min after test | Good | Good | Good | Good | Good | Good | Good |

| | | | Example | | | Comparative Example | | | |
|---|---|---|---|---|---|---|---|---|---|
| | | | 39 | 40 | 41 | 7 | 8 | 9 | 10 |
| Viscosity index improver composition | | | (R15) | (R16) | (R17) | (S1) | (S2) | (S3) | (S4) |
| Amount added (parts by weight) | Viscosity index improver composition | | 22.6 | 24.6 | 23.2 | 17.9 | 17.9 | 17.9 | 18.4 |
| | Additive-blended base oil (10 wt % of additive 1 is added to base oil 1) | | 77.4 | 75.4 | 76.8 | 82.1 | 82.1 | 82.1 | 81.6 |
| Lubricant composition | | | (V15) | (V16) | (V17) | (W1) | (W2) | (W3) | (W4) |
| Amount (wt %) of copolymer (A) in lubricant composition | | | 6.70 | 7.30 | 6.90 | 8.97 | 8.97 | 8.97 | 9.21 |
| Amount (wt %) of chain aliphatic alcohol (B) in lubricant composition | | | 0.076 | 0.083 | 0.071 | — | 0.001 | 0.001 | 0.001 |
| Weight ratio (A/B) in lubricant composition | | | 88 | 88 | 97 | — | 9999 | 9999 | 9999 |
| Kinematic viscosity at 100° C. ($mm^2/s$) | | | 5.00 | 5.00 | 5.00 | 5.00 | 5.00 | 5.00 | 5.00 |
| Kinematic viscosity at 40° C. ($mm^2/s$) | | | 16.90 | 15.65 | 15.51 | 18.1 | 18.1 | 18.1 | 20.1 |
| Viscosity index | | | 255 | 290 | 294 | 228 | 228 | 228 | 190 |
| Shear stability (%) (Sonic SS) | | | 13.0 | 15.1 | 12.8 | 11.9 | 11.9 | 11.9 | 3.1 |
| Low-temperature viscosity (mPa · s) | | | 3300 | 3500 | 3500 | 3300 | 3300 | 3400 | 4600 |
| Antifoaming properties | Immediately after preparation | Immediately after test | Very good | Very good | Very good | Poor | Good | Poor | Good |
| | | 10 min after test | Good | Good | Good | Poor | Good | Good | Good |
| Persistence of antifoaming properties | After shear stability test | Immediately after test | Very good | Very good | Very good | Poor | Poor | Poor | Good |
| | | 10 min after test | Good | Good | Good | Poor | Poor | Good | Poor |

TABLE 5

| | | | Example | | | | | | | Comparative Example | |
|---|---|---|---|---|---|---|---|---|---|---|---|
| | | | 42 | 43 | 44 | 45 | 46 | 47 | 48 | 11 | 12 |
| Viscosity index improver composition | | | (R18) | (R19) | (R20) | (R21) | (R22) | (R23) | (R24) | (S5) | (S6) |
| Amount added (parts by weight) | Viscosity index improver composition | | 5.7 | 13.6 | 11.1 | 6.3 | 12.7 | 11.6 | 12.5 | 14.2 | 14.3 |
| | Additive-blended base oil (10 wt % of additive 2 is added to base oil 3) | | 94.3 | 86.4 | 88.9 | 93.7 | 87.3 | 88.4 | 87.5 | 85.8 | 85.7 |
| Lubricant composition | | | (V18) | (V19) | (V20) | (V21) | (V22) | (V23) | (V24) | (W5) | (VV6) |
| Amount of copolymer (A) in lubricant composition | | | 1.7 | 2.7 | 2.1 | 2.2 | 2.4 | 2.3 | 2.6 | 2.7 | 2.7 |
| Amount of chain aliphatic alcohol (B) in lubricant composition | | | 0.019 | 0.011 | 0.009 | 0.005 | 0.021 | 0.019 | 0.022 | — | 0.011 |
| Weight ratio (A/B) in lubricant composition | | | 88 | 237 | 225 | 416 | 116 | 122 | 119 | — | 237 |
| HTHS viscosity (150° C.) (mPa · s) | | | 2.6 | 2.6 | 2.6 | 2.6 | 2.6 | 2.6 | 2.6 | 2.6 | 2.6 |
| HTHS viscosity (100° C.) (mPa · s) | | | 4.66 | 4.61 | 4.83 | 4.64 | 4.71 | 4.65 | 4.73 | 4.61 | 4.91 |
| Kinematic viscosity at 100° C. ($mm^2/s$) | | | 8.1 | 7.71 | 8.24 | 8.15 | 7.82 | 8.4 | 8.07 | 7.71 | 8.51 |
| Kinematic viscosity at 40° C. ($mm^2/s$) | | | 32.11 | 31.85 | 32.65 | 32.09 | 31.2 | 33.1 | 31.6 | 31.85 | 36.7 |
| Viscosity index | | | 242 | 226 | 244 | 245 | 237 | 246 | 246 | 226 | 221 |
| Shear stability (%) (Sonic SS) | | | 8.8 | 5.6 | 6.9 | 8.0 | 7.3 | 9.4 | 6.1 | 5.6 | 8.1 |
| Shear stability (%) (BOSCH SS) | | | 5.5 | 3.5 | 4.3 | 5.0 | 4.6 | 7.5 | 4.6 | 3.5 | 5.1 |
| Low-temperature viscosit (mPa · s) | | | 27000 | 18000 | 23000 | 24000 | 21000 | 26000 | 19000 | 18000 | 31000 |
| Antifoaming properties | Immediately after preparation | Immediately after test | Excellent | Very good | Very good | Very good | Excellent | Excellent | Excellent | Poor | Good |
| | | 10 min after test | Good | Good | Good | Good | Good | Good | Good | Poor | Good |
| Persistence of antifoaming properties | After shear stability test | Immediately after test | Excellent | Very good | Very good | Very good | Excellent | Excellent | Excellent | Poor | Good |
| | | 10 min after test | Good | Good | Good | Good | Good | Good | Good | Poor | Poor |

TABLE 6

| | | | Example | | | | | | | Comparative Example | |
|---|---|---|---|---|---|---|---|---|---|---|---|
| | | | 49 | 50 | 51 | 52 | 53 | 54 | 55 | 13 | 14 |
| Viscosity index improver composition | | | (R18) | (R19) | (R20) | (R21) | (R22) | (R23) | (R24) | (S5) | (S6) |
| Amount added (parts by weight) | Viscosity index improver composition | | 3.6 | 8.5 | 6.9 | 3.9 | 8.0 | 7.5 | 7.9 | 8.9 | 8.9 |
| | Additive-blended base oil (10 wt % of additive 2 is added to base oil 3) | | 96.4 | 91.5 | 93.1 | 96.1 | 92.0 | 92.5 | 92.1 | 91.1 | 91.1 |
| Lubricant composition | | | (V25) | (V26) | (V27) | (V28) | (V29) | (V30) | (V31) | (W7) | (W8) |
| Amount of copolymer (A) in lubricant composition | | | 1.1 | 1.7 | 1.3 | 1.4 | 1.5 | 1.5 | 1.7 | 1.7 | 1.7 |
| Amount of chain aliphatic alcohol (B) in lubricant composition | | | 0.012 | 0.007 | 0.006 | 0.003 | 0.013 | 0.012 | 0.014 | — | 0.007 |
| Weight ratio (A/B) in lubricant composition | | | 88 | 237 | 225 | 416 | 116 | 122 | 119 | — | 237 |
| HTHS viscosity (150° C.) (mPa · s) | | | 2.3 | 2.3 | 2.3 | 2.3 | 2.3 | 2.3 | 2.3 | 2.3 | 2.3 |
| HTHS viscosity (100° C.) (mPa · s) | | | 4.42 | 4.38 | 4.58 | 4.40 | 4.47 | 4.42 | 4.48 | 4.38 | 4.66 |
| Kinematic viscosity at 100° C. ($mm^2/s$) | | | 6.79 | 6.51 | 6.89 | 6.84 | 6.56 | 6.98 | 6.66 | 6.47 | 7.14 |
| Kinematic viscosity at 40° C. ($mm^2/s$) | | | 28.41 | 27.80 | 29.11 | 28.75 | 27.60 | 29.40 | 27.90 | 27.80 | 32.47 |
| Viscosity index | | | 212 | 201 | 210 | 211 | 206 | 212 | 209 | 201 | 192 |
| Shear stability (%) (Sonic SS) | | | 7.4 | 4.7 | 5.8 | 6.7 | 6.1 | 7.9 | 5.1 | 4.7 | 6.8 |
| Shear stability (%) (BOSCH SS) | | | 4.6 | 2.9 | 3.6 | 4.2 | 3.8 | 6.3 | 3.8 | 2.9 | 4.3 |
| Low-temperature viscosity (mPa · s) | | | 21500 | 14400 | 18000 | 19200 | 16500 | 21000 | 15000 | 14400 | 25000 |
| Antifoaming properties | Immediately after preparation | Immediately after test | Excellent | Very good | Very good | Very good | Excellent | Excellent | Excellent | Poor | Good |
| | | 10 min after test | Good | Good | Good | Good | Good | Good | Good | Poor | Good |
| Persistence of antifoaming properties | After shear stability test | Immediately after test | Excellent | Very good | Very good | Very good | Excellent | Excellent | Excellent | Poor | Good |
| | | 10 min after test | Good | Good | Good | Good | Good | Good | Good | Poor | Poor |

The results of Table 4, Table 5, and Table 6 demonstrate that the viscosity index improver compositions of the present invention have an excellent viscosity index improving effect and can provide lubricant compositions having excellent antifoaming properties and excellent persistence of the antifoaming properties. Also demonstrated is that the lubricant compositions have excellent shear stability and excellent low-temperature viscosity.

On the other hand, the lubricant compositions of Comparative Examples 7, 11, and 13 using the viscosity index improver composition of Comparative Example 1 or 5 containing no chain aliphatic alcohols (B) have low antifoaming properties and low persistence of the antifoaming properties. Further, the lubricant composition of Comparative Example 8 using the viscosity index improver composition of Comparative Example 2 containing conventionally used polydimethylsiloxane is compared to the lubricant composition of Example 25, which is the same as the composition of Comparative Example 8 except that the composition of Example 25 contains no chain aliphatic alcohols (B) but contains the comparative compound (B') (they contain the same (co)polymer (A)). The comparison shows that the composition of Comparative Example 8 has extremely lower persistence of antifoaming properties and lower shear stability (Sonic SS). Similarly, the lubricant composition of Comparative Example 9 using the viscosity index improver composition of Comparative Example 3 containing a C12 chain aliphatic alcohol is compared to the lubricant composition of Example 25, which is the same as the composition of Comparative Example 9 except for the type of the chain aliphatic alcohol (B). The comparison shows that the composition of Comparative Example 9 has lower antifoaming properties immediately after the test and lower shear stability (Sonic SS). Further, the lubricant compositions of Comparative Examples 10, 12, and 14 using the viscosity index improver composition of Comparative Example 4 or 6 containing a copolymer free from the monomer (a) as a constituent monomer are compared to the lubricant compositions of Examples 25, 44, and 51, which are the same as the compositions of Comparative Examples 10, 12 and 14 except that the compositions of Examples 25, 44, and 51 contain the monomer (a). The comparison shows that the compositions of Comparative Examples 10, 12, and 14 have a lower viscosity index and lower antifoaming properties.

The above-described results demonstrate that since the lubricant compositions containing the viscosity index improver compositions of the present invention contain the (co)polymer (A) containing the monomer (a) as an essential monomer and the C18-C40 chain aliphatic alcohol (B), the lubricant compositions have high viscosity index, excellent antifoaming properties, excellent persistence of the antifoaming properties, excellent shear stability, and excellent low-temperature viscosity.

INDUSTRIAL APPLICABILITY

The lubricant compositions of the present invention have an excellent viscosity index improving effect, excellent antifoaming properties, and excellent persistence of the antifoaming properties and are thus suitable as viscosity index improvers for gear oils (e.g., differential oil and industrial gear oil), MTF, transmission fluids (e.g., ATF, DCTF, and belt-CVTF), engine oils, traction fluids (e.g., toroidal-CVTF), shock absorber fluids, power steering fluids, and hydraulic oils (e.g., construction machinery hydraulic oil and industrial hydraulic oil). The lubricant compositions of the present invention are suitable for gear oils (e.g., differential oil and industrial gear oil), MTF, transmission fluids (e.g., ATF, DCTF, and belt-CVTF), engine oils, traction fluids (e.g., toroidal-CVTF), shock absorber fluids, power steering fluids, hydraulic oils (e.g., construction machinery hydraulic oil and industrial hydraulic oil), and the like.

The invention claimed is:

1. A viscosity index improver composition, comprising:

a (co)polymer (A) comprising a monomer (a) represented by the following formula (1) as an essential monomer;

a C18-C40 chain aliphatic alcohol (B); and a base oil,

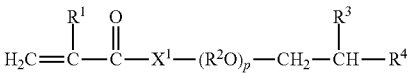

(1)

wherein $R^1$ is a hydrogen atom or a methyl group; —$X^1$— is a group represented by —O— or —NH—; $R^2$ is a C2-C4 alkylene group; $R^3$ and $R^4$ are each independently a C8-C24 linear or branched alkyl group; and p is an integer of 0 to 20, with each $R^2$ being optionally the same as or different from each other when p is 2 or greater.

2. The viscosity index improver composition according to claim 1, wherein the (co)polymer (A) is a copolymer further comprising a (meth)acrylic acid alkyl ester (b) having a C1-C4 alkyl group, as a constituent monomer.

3. The viscosity index improver composition according to claim 1, wherein the (co)polymer (A) has a weight average molecular weight of 5,000 to 2,000,000.

4. The viscosity index improver composition according to claim 1, wherein a weight ratio (A/B) of the (co)polymer (A) to the chain aliphatic alcohol (B) is 10 to 10,000.

5. The viscosity index improver composition according to claim 1, wherein the base oil has a kinematic viscosity at 100° C. of 1 to 15 $mm^2/s$ and a viscosity index of 90 or higher.

6. A lubricant composition, comprising:

the viscosity index improver composition according to claim 1; and at least one additive selected from the group consisting of a detergent, a dispersant, an antioxidant, an oiliness improver, a pour point depressant, a friction and wear modifier, an extreme pressure agent, a demulsifier, a metal deactivator, and a corrosion inhibitor.

* * * * *